US006492973B1

(12) United States Patent
Kuroki et al.

(10) Patent No.: US 6,492,973 B1
(45) Date of Patent: Dec. 10, 2002

(54) METHOD OF DRIVING A FLAT DISPLAY CAPABLE OF WIRELESS CONNECTION AND DEVICE FOR DRIVING THE SAME

(75) Inventors: Futoshi Kuroki, Kure (JP); Tetsu Araki, Chiba (JP); Hiroya Sato, Nara (JP); Tamotsu Aoki, Otawara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/407,073

(22) Filed: Sep. 28, 1999

(30) Foreign Application Priority Data

Sep. 28, 1998 (JP) ..... 10-273247

(51) Int. Cl.[7] ..... G09G 3/36
(52) U.S. Cl. ..... 345/100; 348/726; 375/376
(58) Field of Search ..... 345/87, 88, 89, 345/98, 99, 100, 204; 348/790–793, 725, 726, 728; 725/81, 106, 131

(56) References Cited

U.S. PATENT DOCUMENTS

| | | | | | |
|---|---|---|---|---|---|
| 4,368,467 | A | * | 1/1983 | Unotoro et al. | 345/1.3 |
| 5,699,076 | A | * | 12/1997 | Tomiyasu | 345/103 |
| 5,793,413 | A | * | 8/1998 | Hylton et al. | 725/81 |
| 5,940,457 | A | * | 8/1999 | Dreifuss et al. | 375/376 |
| 6,016,313 | A | * | 1/2000 | Foster, Jr. et al. | 370/330 |
| 6,263,503 | B1 | * | 7/2001 | Margulis | 725/81 |

FOREIGN PATENT DOCUMENTS

| | | |
|---|---|---|
| JP | U6-77086 | 10/1994 |
| JP | A9-294271 | 11/1997 |

* cited by examiner

*Primary Examiner*—Bipin Shalwala
*Assistant Examiner*—Mansour M. Said
(74) *Attorney, Agent, or Firm*—Birch, Stewart, Kolasch & Birch, LLP

(57) ABSTRACT

A signal to be displayed that is output from a display signal source is upconverted and transmitted in the form of a millimeter-wave which is in turn downconverted and supplied to a flat display and displayed there.

19 Claims, 28 Drawing Sheets

SIGNAL TO BE TRANSMITTED

| DELIMITER SIGNAL | CONTROL INFORMATION | DISPLAY INFORMATION | DELIMITER SIGNAL |
|---|---|---|---|

METHOD OF DRIVING A FLAT DISPLAY CAPABLE OF WIRELESS CONNECTION AND DEVICE FOR DRIVING THE SAME

BACKGROUND OF THE INVENTION

1 Field of the Invention

The present invention relates generally to methods of driving a flat display used as a thin display device, a wall-hung display device and the like and devices driving the same, and in particular to wirelessly connecting a display signal source and the flat display together and reducing the thickness, weight and cost of the flat display.

2. Description of the Background Art

A flat display used as a thin display device, a wall-hang display device or the like has been developed employing a thin film transistor (TFT), ferroelectric crystal liquid (FLCD), an STN liquid crystal display device, a plasma display or a combination of liquid crystal and a plasma display or PALC, electroluminescence (EL), a light emitting diode (LED) display, or the like, and it has also been increased in size and enhanced in definition year after year. The flat display is connected to a signal source, such as a personal computer, a TV set, Internet, a TV phone, a TV conference system. Wirelessly connecting the display signal source and the flat display has also been considered in order to alleviate the flat display's circuit burden, weight and cost.

Table 1 represents a relationship between the flat display's definition, clock frequency and displaying-color count.

TABLE 1

| Panel Resolution | | Dot Clock | Serial Bit Rate 18-bit Color | Serial Bit Rate 24-bit Color |
|---|---|---|---|---|
| VGA | 640 × 480 (60 Hz) | 25 MHz | 0.60 Gpbs | 0.75 Gpbs |
| SVGA | 800 × 600 (60 Hz) | 40 MHz | 0.96 Gpbs | 1.20 Gpbs |
| XGA | 1024 × 768 (60 Hz) | 65 MHz | 1.56 Gbps | 1.95 Gpbs |
| SXGA | 1240 × 1024 (60 Hz) | 108 MHz | 2.59 Gpbs | 3.24 Gpbs |
| UXGA | 1600 × 1200 (60 Hz) | 162 MHz | 3.89 Gbps | 4.86 Gpbs |
| HDTV (1080-I) | 1920 × 1080 (30 Hz) | 74.25 MHz | 1.78 Gbps | 2.23 Gbps |
| HDTV (1080-P) | 1920 × 1080 (60 Hz) | 148.5 MHz | 3.56 Gbps | 4.46 Gpbs |
| SHD | 2048 × 2048 (60 Hz) | +317 MHz | 7.61 Gbps | 9.51 Gbps |

It is apparent from Table 1 that with a panel resolution of VGA (640×480), 0.60 Gbps and 0.75 Gbps are required for 18- and 24-bit colors, respectively. To display a high-vision image with a resolution of 1920×1080, 4.46 Gbps is required.

Japanese Patent Laying-Open No. 9-294271 discloses a technique of sending image data from a personal computer to a liquid crystal projector through infrared transmission and storing the image data in the liquid crystal projector. Japanese Utility Model Laying-Open No. 6-77086 also describes a technique of configuring a disc player and a liquid crystal display removably and communicating signals therebetween through a wire or wirelessly. The publications describing such techniques, however, do not fully describe any forms of transmitted and received signals, any configuration of a transmitter, any configuration of a receiver, or the like in detail.

Furthermore, while signal transmission rates of 0.75 Gbps and 4.46 Gbps are required for the VGA and high-vision panel resolutions, respectively, infrared only has a signal transmission rate of approximately at most 100 MBPS. This is a limitation in using infrared to wirelessly connect a flat display.

SUMMARY OF THE INVENTION

The present invention contemplates a method and device driving a flat display, capable of wirelessly coupling the flat display and a display signal source together.

Briefly speaking, the present invention provides a method of driving a flat display, including the steps of: upconverting a signal output from a display signal source to be displayed into a millimeter-wave and transmitting the millimeter-wave; receiving and downconverting the millimeter-wave to output the signal to be displayed; and supplying the signal to be displayed to the flat display.

The present invention, in another aspect, is a flat display drive device comprised of a display signal source, a first frequency converting circuit, a millimeter-wave transmission circuit, a millimeter-wave reception circuit, a second frequency conversion circuit, a signal separation circuit, a flat display, an x-direction driver, and a y-direction driver.

A display signal source generates a signal to be displayed. The first frequency converting circuit receives the signal to be displayed and converts it into a millimeter-wave. The millimeter-wave transmission circuit produces a radio-frequency (RF) wave for transmitting the millimeter-wave. The millimeter-wave reception circuit receives the radio-frequency wave to produce a millimeter-wave. Second frequency conversion circuit receives the millimeter-wave from the millimeter-wave reception circuit and converts it into the signal to be displayed. The signal separation circuit receives the signal to be displayed from the second frequency conversion circuit and separates it into an x-direction image signal and a y-direction image signal.

The flat display has a plurality of display elements arranged in a matrix, including an x-direction drive line arranged for each row of display elements and a y-direction chive line arranged for each column of display elements. The x-direction driver responds to the x-direction image signal by supplying to the x-direction drive line a voltage signal for driving a display element. The y-direction driver responds to the y-direction image signal by supplying to the y-direction drive line a voltage signal for driving a display element.

The present invention in still another aspect is a flat display drive device comprised of a display signal source, a signal separation circuit, a modulation circuit, a frequency converting circuit, a milliwave transmitter, a miniwave receiver, a demodulation circuit, a flat display, an x-direction driver, a y-direction driver, and first and second signal supply circuits.

The display signal source generates a signal to be displayed. The signal separation circuit separates the signal to be displayed into x- and y-direction signals for driving the flat display. The modulation circuit uses the x- and y-direction signals to modulate an intermediate frequency (IF) wave. The frequency converting circuit converts the IF wave modulated by the modulation circuit into a radio-frequency wave. The millimeter-wave transmitter generates a radio-frequency wave for transmitting a milimeter-wave. The millimeter-wave receiver receives the radio-frequency wave to produce a millimeter-wave. The demodulation circuit demodulates the millimeter-wave into x- and y-direction signals.

The flat display has a plurality of display elements arranged in rows and columns and also includes an x-direction drive line arranged for each row of display elements and a y-direction drive line arranged for each column of display elements. The x-direction driver supplies an x-direction signal to the x-direction drive line. The y-direction driver supplies a y-direction signal to the y-direction drive line. The first signal supply circuit supplies an x-direction signal to the x-direction driver. The second signal supply circuit supplies a y-direction signal to the y-direction driver.

The present invention in still another aspect is a flat display drive device comprised of a display signal source, a signal separation circuit, a modulation circuit, a millimeter-wave transmitter, a millimeter-wave receiver, a demodulation circuit, a flat display, an x-direction driver, a y-direction driver, and first and second signal supply circuits.

The display signal source generates a signal to be displayed. The signal separation circuit separates the signal to be displayed into x- and y-direction signals for driving the flat display. The modulation circuit modulates a millimeter-wave, depending on a signal obtained by time-division multiplexing the x- and y-direction signals. The millimeter-wave transmitter transmits via a radio-frequency wave a millimeter-wave corresponding to the milimeter-wave modulated by the modulation circuit, and the millimeter-wave transmitter incorporates a digital modulator therein.

The modulation circuit uses the x- and y-direction signals to modulate an intermediate-frequency (IF). The frequency converting circuit converts the IF wave modulated by the modulation circuit into a radio-frequency wave. The millimeter-wave transmitter generates a radio-frequency wave for transmitting a millimeter-wave. The millimeter-wave receiver receives the radio-frequency wave to produce a millimeter-wave. The demodulation circuit demodulates the millimeter-wave into x- and y-direction signals.

The flat display has a plurality of display elements arranged in rows and columns and also includes an x-direction drive line arranged for each row of display elements and a y-direction drive line arranged for each column of display elements.. The x-direction driver supplies an x-direction signal to the x-direction drive line. The y-direction driver supplies a y-direction signal to the y-direction chive line. The first signal supply circuit supplies an x-direction signal to the x-direction driver. The second signal supply circuit supplies a y-direction signal to the y-direction driver.

Thus a main advantage of the present invention is that since a display signal is transmitted and received in a millimeter-wave, ultra high-speed transmission of data greater in frequency than high-vision video signals can be achieved and the display signal's bandwidth can be adequately covered to reduce transmission noise and modulation noise. Furthermore, since the display signal source and the flat display are coupled together wirelessly via a millimeter electric wave, the display signal source and the flat display can be arranged as desired to effectively enjoy the characteristics of the flat display, i.e., reduced thickness and weight.

Furthermore, millimeter-wave, harmless to the human body and also highly directional, allows the display signal source and the flat display to be readily matched in directionality. A millimeter-wave can also be damped significantly in the atmosphere, and it is thus advantageous in reduction of interference on other communication circuits and in reuse of a frequency space when it is used for relatively short distance communications, such as in a household, an office or the like.

Furthermore, since the transmitting side previously separates a signal to be displayed into x- and y-direction signals before it is transmitted, in the flat display the received x- and y-direction signals can be used to directly drive the x- and y-direction drive lines and a simple circuit configuration can thus be used to drive the display. Furthermore, in providing a 2-screen display, for example, the transmitting side is only required to transmit a signal to be displayed corresponding to a portion desired to be displayed and it is thus not necessary to transmit the data corresponding to the entire screen of the flat display, so that a transmission band can be used effectively.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1A:
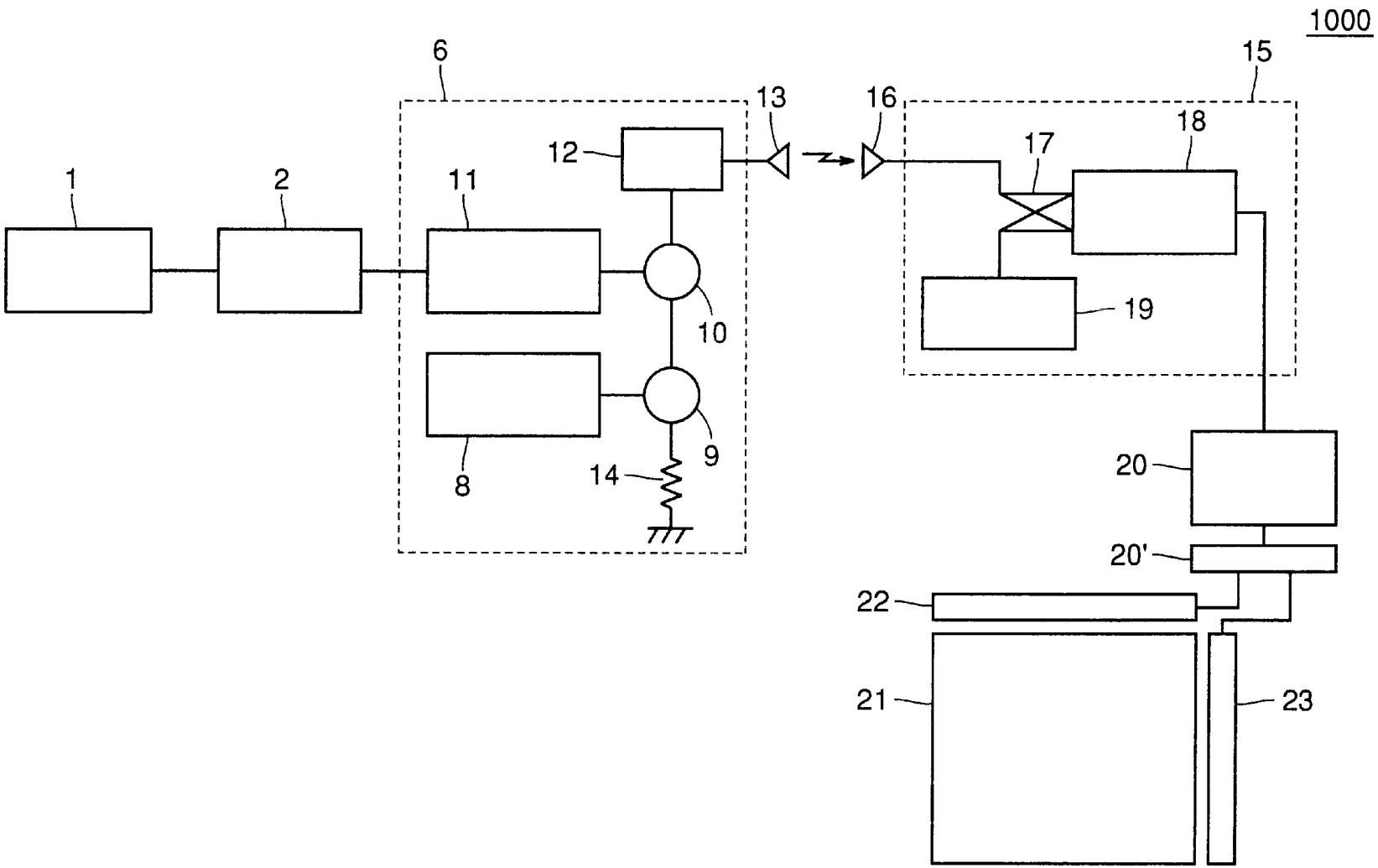
FIGS. 1A and 1B are block diagrams showing a schematic configuration and another configuration, respectively, of a flat display drive device according to a first embodiment of the present invention.

FIG. 1A is a block diagram showing a schematic configuration of a flat display drive device 1000 according to a first embodiment of the present invention. Flat display drive device 1000 is comprised of a display signal source 1. Display signal source 1 is, e.g., a personal computer, a TV set, Internet, a TV phone, a TV conference system, a video camera or the like which outputs a signal to be displayed on a flat display. For example, when the display signal source is a personal computer with a CPU, a memory, a hard disc, a display control circuit or other peripheral devices connected thereto, display signal source 1 outputs data to be displayed, a clock signal and a synchronizing signal.

Figure 2:
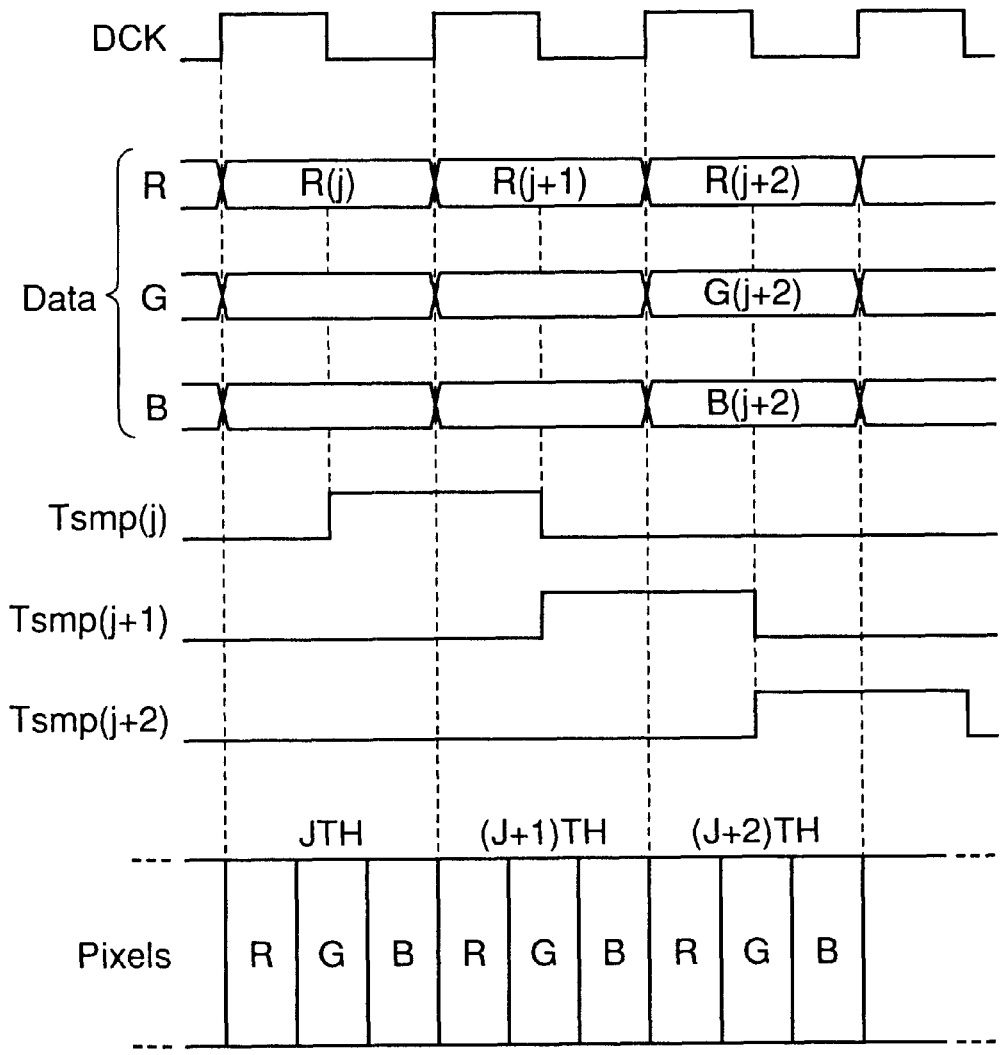
FIG. 2 represents a relationship between a pixel, data to be displayed and sampling pulse in a display signal source.

FIG. 2 represents a relationship between a pixel, data to be displayed, and a sampling pulse. Referring to FIG. 2, the data to be displayed (Data) is comprised of red-, green- and blue-color data R, G and B respectively defining red-, green- and blue-color components that are output from a personal computer. For a 260,000-color display, for example, each color data is configured of six bits. The clock signal (DCK) is a pulsed signal, its one cycle corresponding to one pixel. The sampling pulse (Tsmp) is applied to sampling circuits respectively provided for pixels j, j+1, j+2 . . . When the sampling pulse rises the data to be displayed (Data) of a pixel is sampled and converted from a parallel signal to a serial signal and then output from the display signal source. It is also desirable that the other signals output from the display signal source, clock signal DCK and sampling pulse Tsmp, also be converted into serial signals together with the data to be displayed.

Flat display drive device 1000 is also comprised of an intermediate frequency band (IF band) ASK/PSK/FSK modulator 2 receiving the serial signal output from display signal source 1 to be displayed and applying ASK, PSK, or FSK modulation to the received serial signal to output an IF signal, and an NRD guide transmitter 6 having an incorporated upconverter and receiving the ASK-, PSK- or FSK-modulated: IF signal. (ASK-amplitude shift keying; FSK-frequency shift keying; and PSK-phase shift keying).

Furthermore, an analog-digital converter may be arranged between the display signal source and ASK modulation circuit 2 so that digital data to be displayed can be ASK/PSK/FSK-modulated to obtain an IF signal. In this example, data to be displayed can be effectively prevented from degradation associated with signal transmission, to enhance the image quality of the flat display.

NRD guide transmitter 6 with an incorporated upconverter includes a Gunn diode oscillator 8 with an oscillation frequency turned to the 59 GHz band, a circulator 9, 10 for an NRD guide transmitting an oscillating signal from Gunn diode oscillator 8 in a predetermined direction, and an upconverter 11 comprised of a schottky barrier diode. Upconverter 11 mixes the local oscillation (LO) wave from Gunn diode oscillator 8 and a IF signal from the ASK/PSK/FSK modulator together and upconverts the mixture to a 60 GHz band signal. The signal with its frequency converted is passed to bandpass filter 12 and an upper side-band with the frequency of 60 GHz is only transmitted to a transmitting antenna 13. A lower side-band with the frequency of 58 GHz cannot pass through bandpass filter 12 and it is reflected and guided by circulators 10 to a matched load 14 and absorbed there. Transmitting antenna 13 receives the guided RF wave with the frequency of 60 GHz, i.e., the upper side-band signal.

Description will now be made of another exemplary configuration of the flat display drive device according to the first embodiment. The FIG. 1B flat display drive device 1010 is distinguished from The FIG. 1A flat display drive device 1000 in that a serial signal to be displayed is input to a millimeter-wave ASK/PSK/FSK modulator to directly subject a millimeter-wave to ASK/PSK/FSK modulation. Flat display drive device 1010 includes an NRD guide transmitter 6' with an incorporated digital modulator in place of NRD guide transmitter 6 with an incorporated upconverter. In NRD guide transmitter 6' with an incorporated digital modulator, Gunn diode 8 with an oscillation frequency turned to 60.5 GHz outputs an RF wave which is in turn transmitted in a predetermined direction via circulators 9, 10 for NRD guides and input to a millimeter-wave ASK/PSK/FSK modulator 11' which directly, digitally modulates and transmits a signal to transmitting antenna 13.

Figure 1B:
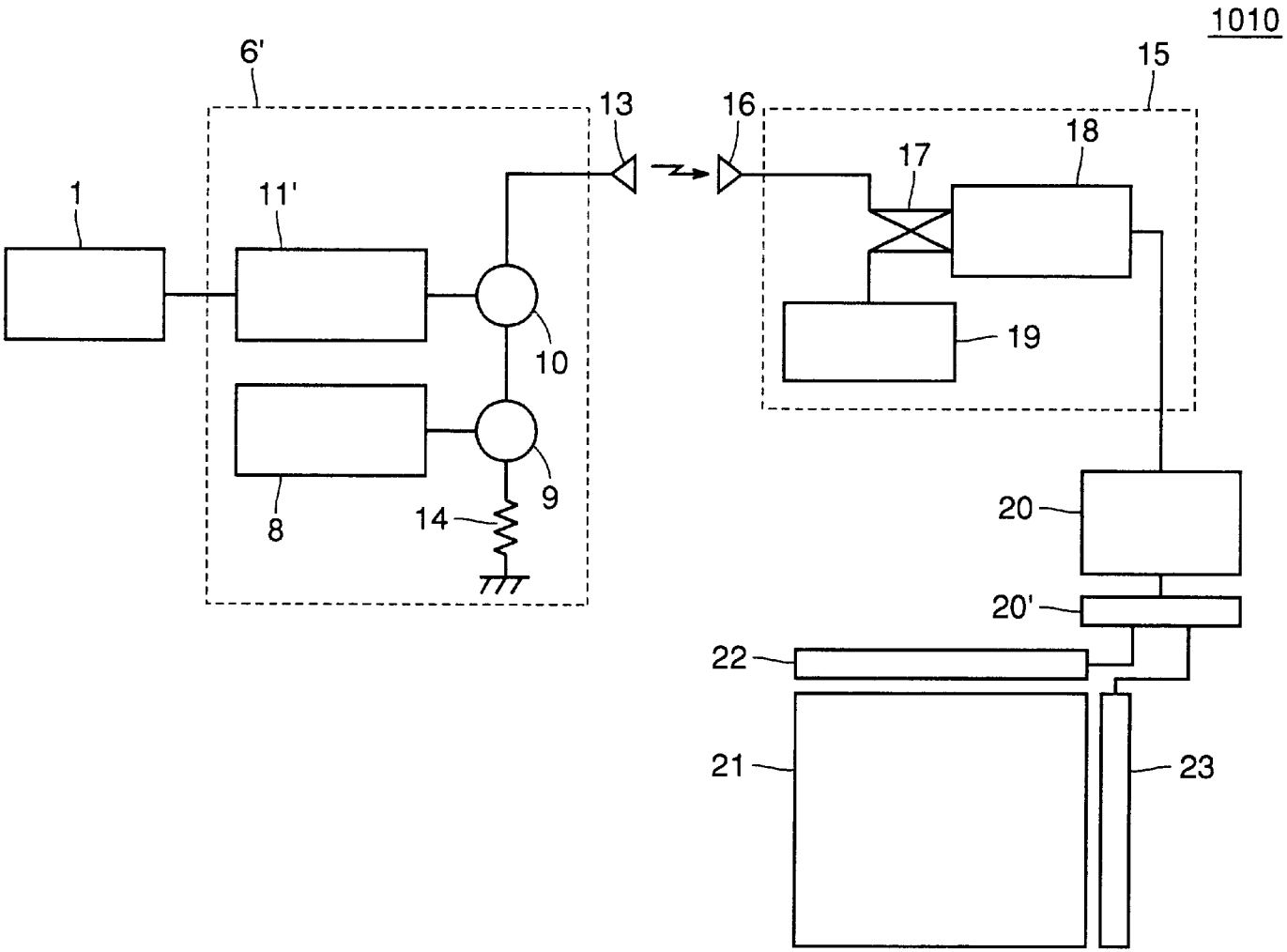

The FIGS. 1A and 1B flat display drive devices 1000 and 1010 are identical in the configuration of the circuit receiving an RF wave of the 60 GHz band transmitted via transmitting antenna 13 of drive device 1000 transmitter 6 or drive device 1010 transmitter 6'. Accordingly, it will be described representatively in conjunction with the FIG. 1A flat display drive device 1000.

Display drive device 1000 is also comprised of a receiving antenna 16 receiving an RF wave of the 60 GHz band transmitted from transmitting antenna 13 and an NRD guide receiver 15 for obtaining the original IF signal from the received signal of the 60 GHz band. NRD guide receiver 15 includes an NRD-guide directional coupler 17 transmitting the received RF wave, a balanced mixer 18 receiving the RF wave transmitted from NRD-guide directional coupler 17, and a Gunn diode oscillator 19 applying an LO wave of the 59 GHz band to balanced mixer 18. Balanced mixer 18 uses the LO wave of the 59 GHz band to downconvert the RF wave of the 60 GHz band into the original IF signal and output it. The IF signal is demodulated in an ASK/PSK/FSK demodulator 20. A signal separation circuit 20' separates the demodulated IF signal into x- and y-direction signals to be displayed and outputs them.

Flat display drive device 1000 is also comprised of a flat display 21 configured, e.g., of a thin film transistor (TFT), a liquid crystal display device using the STN or ferroelectric liquid crystal (FLCD), a plasma display panel, a combination of liquid crystal and a plasma display or a PALC, an electroluminiscense (EL) panel, a light emitting diode (LED) display or the like, and x-direction driver 22 of flat display 21, an a y-direction driver 23 of flat display 21. Flat display 21 has a plurality of pixels arranged in a matrix. X- and y-direction drivers 22 and 23 respond to x- and y-direction signals to be displayed, respectively, by supplying data to be displayed to a corresponding pixel in flat display 21. The division of a signal to be displayed in the x and y directions and the application thereof to a pixel in a matrix allows the flat display drive device to have a simplified configuration.

Schematically, the flat display drive device of the present invention is configured as above.

That is, the present invention is characterized in that a signal to be displayed that is output from a display signal source is converted into a milliwave signal before it is transmitted.

Figure 3:
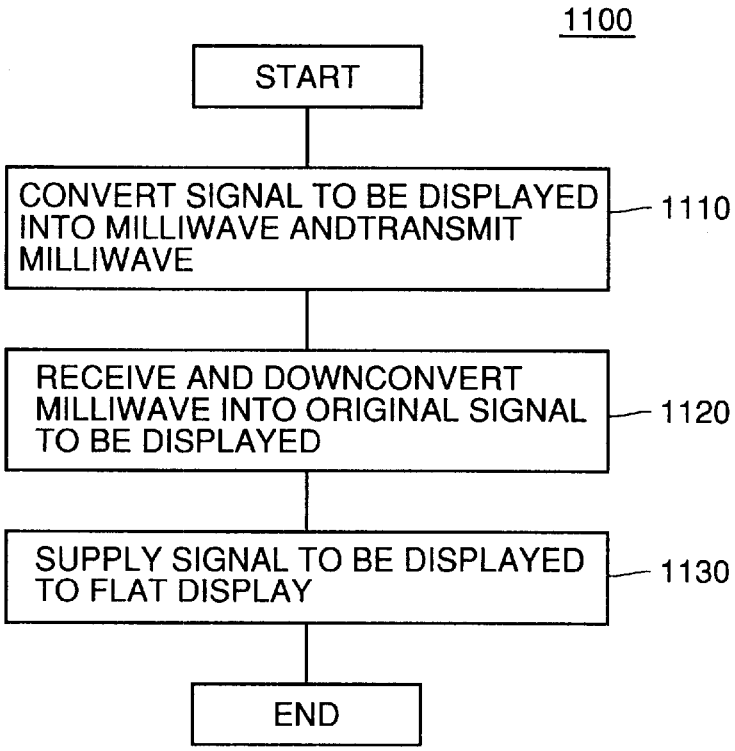
FIG. 3 is a flow chart representing a method 1100 of driving a flat display in accordance with the present invention.

FIG. 3 is a flow chart representing a flat display driving method 1100 of the present invention.

Referring to FIG. 3, flat display driving method 1100 includes step 1110 of upconverting a signal to be displayed from a display signal source into a millimeter-wave and transmitting the millimeter-wave, step 1120 of receiving the transmitted millimeter-wave and downconverting it to output the original signal to be displayed, and step 1130 of applying the signal to be displayed to a flat display.

Step 1110 corresponds to NRD guide transmitter 6 of flat display drive device 1000 shown in FIG. 1. Step 1120 corresponds to NRD receiver 15. Step 1130 corresponds to x- and y-direction drivers 22 and 23.

Transmission via millimeter-wave allows the transmitter and the receiver to be simplified in configuration.

Furthermore, if in step 1100 a signal to be displayed from the display signal source is A-D converted and the obtained digital signal is upconverted into a milliwave signal, the data to be displayed can be effectively prevented from degradation associated with signal transmission, to enhance the image quality of the flat display.

Furthermore, the upconversion in step 1110 and the downconversion in step 1120 may also be provided through PSK, ASK or FSK modulation and PSK, ASK or FSK demodulation, respectively, in preventing the gradation of a signal to be displayed so as to maintain a high display quality of the flat display.

Furthermore the flat display drive device can be simplified in configuration if in step 1130 a signal to be displayed is separated into signals to be displayed in the x and y directions of the flat display before it is applied to the flat display.

Each component of the flat display drive device will now be described in detail.

Figure 4:
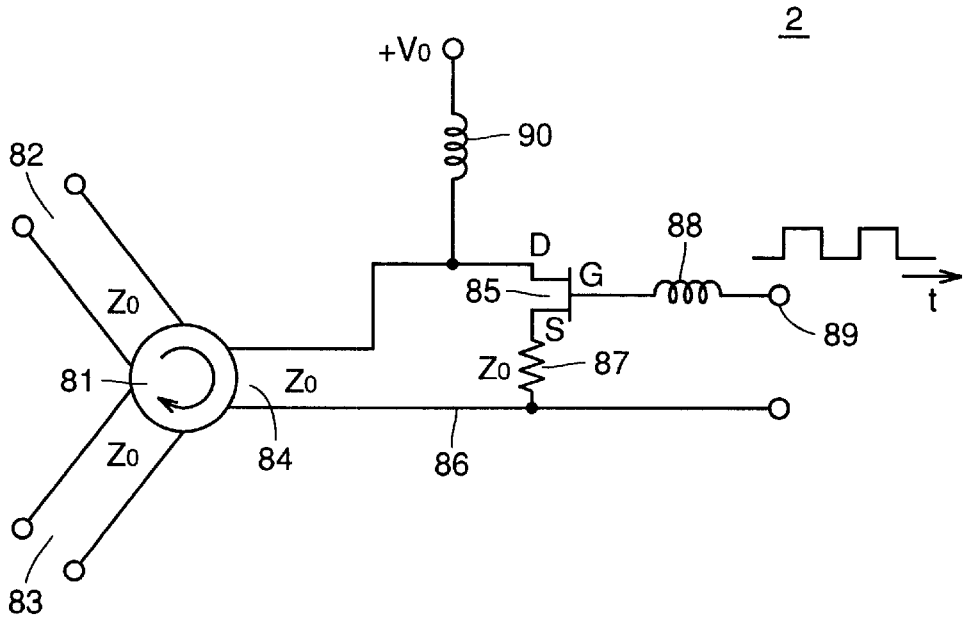
FIG. 4 illustrates a configuration of an ASK modulator with FET 2.

Although a serial signal to be displayed is ASK-, PSK- or FSK-modulated, the following description will be provided in conjunction with ASK modulation. As shown in FIG. 4, ASK modulator 2 includes a circulator 81, a modulation port 84 arranged between the circulator's input terminal port 82 and output terminal port 83, and a field effect transistor (FET) 85 having its drain and source terminals electrically coupled with modulation port 84. ASK modulator 2 includes a resistor 87 connected between the source of FET 85 and an earth 86 and having a resistance equal to a characteristic impedance $Z_0$ of a line, an RF choke 88 connected to the gate of FET 85, a terminal 89 connected to RF choke 88 to receive a high-speed data signal, and a noise removing choke 90 connected between the drain of FET 85 and a power supply terminal.

By ASK-, PSK- or FSK-modulating a signal to be displayed, degradation of the signal can be prevented to maintain a high display quality of the flat display.

Let us now assume that ASK modulator 2 configured as above with a GaAs FET used as FET 85 receives continuous RF wave at input terminal port 82 and a high-speed data signal at terminal 89. When the high-speed data signal is of high level (0V), a high resistance is provided between FET 85 drain and source and a transmitted wave input to FET 85 receives reflection and is output to output terminal port 83. When the high-speed data signal is of low level (negative several V), a low resistance is provided between FET 85 drain and source so that matching is achieved at resistor 87 connected between FET 85 source and the earth and any transmitted wave does not appear at output terminal port 83. The ASK modulator is configured based on the series of operations as described above.

Thus, when input terminal port 82 receives continuous millimeter-wave and terminal 89 receives a serial signal to be displayed from the display signal source, the continuous millimeter-wave is ASK-modulated by the signal to be displayed and a modulated millimeter-wave is output at output terminal port 83.

Figure 5:
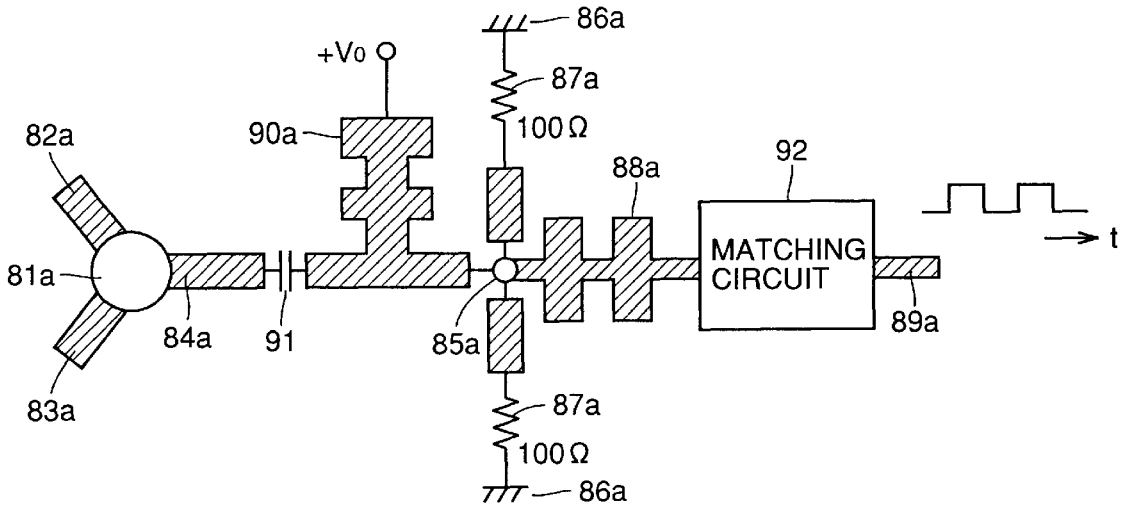
FIG. 5 illustrates a configuration of the ASK modulator with FET configured of a microstrip.

FIG. 5 shows an example in which the FIG. 4 circuit is applied to a microstrip. In the figure, the components corresponding to those in FIG. 4 are denoted by the same reference characters plus a letter a. It should be noted that reference numeral 91 denotes a direct-current preventing capacitor and reference numeral 92 denotes a matching circuit. The ASK modulation in the FIG. 5 circuit is similar to that in the FIG. 4 circuit.

Figure 6A:
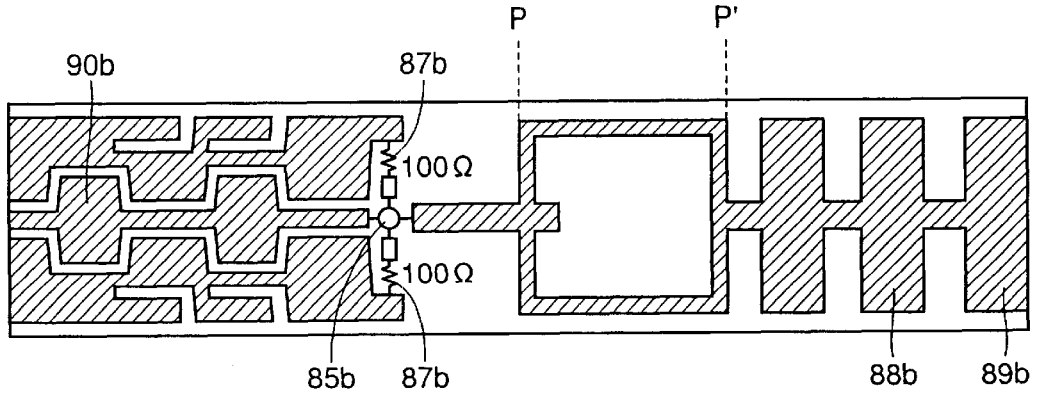
FIGS. 6A and 6B are a side view and a plan view, respectively, of an NRD guide configured through application of an ASK modulator with FET.
Figure 6B:
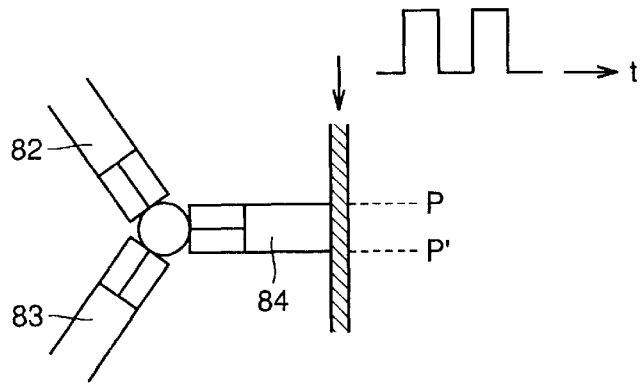

FIGS. 6A and 6B show an example in which the FIG. 4 circuit is applied to an NRD guide. In the figure, the components corresponding to those in FIG. 4 are labeled by the same reference characters plus a letter b.

Figure 7:
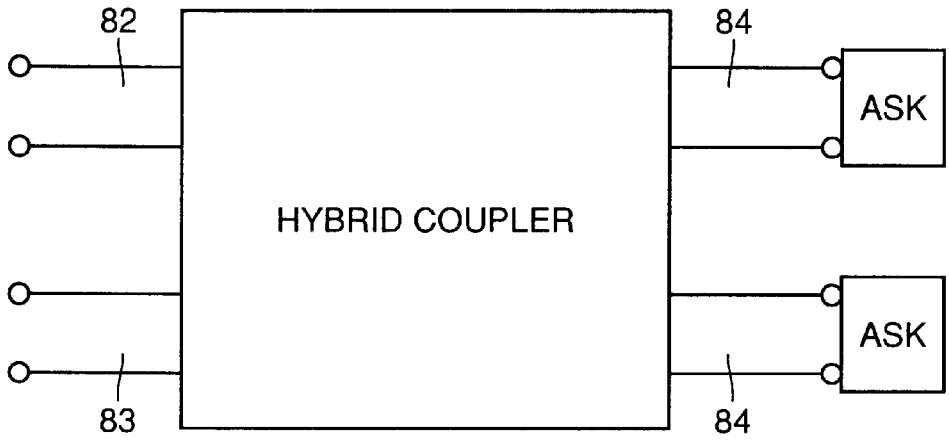
FIG. 7 is a block diagram showing an example of an ASK modulator 85 configured with a 3 dB directional coupler.

In the FIG. 4 circuit, circulator 81 can be changed by a 3 dB directional coupler 93 arranged between input terminal port 82 and output terminal port 83 and modulation port 84, as shown in FIG. 7. Such circuit configuration is suitable when a microctrip is configured of a printed line.

Figure 8A:
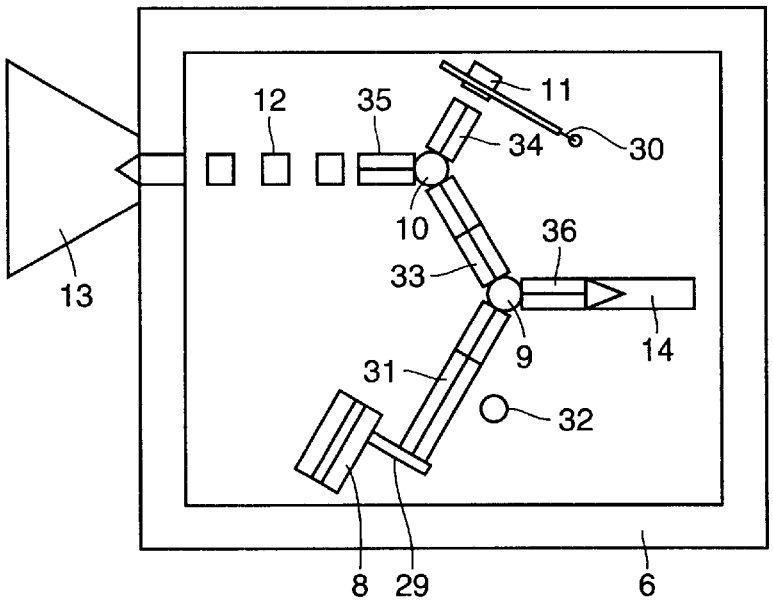
FIGS. 8A and 8B are a plan view and a three-dimensional view, respectively, of an NRD transmitter 6 incorporating the upconverter 11
Figure 8B:
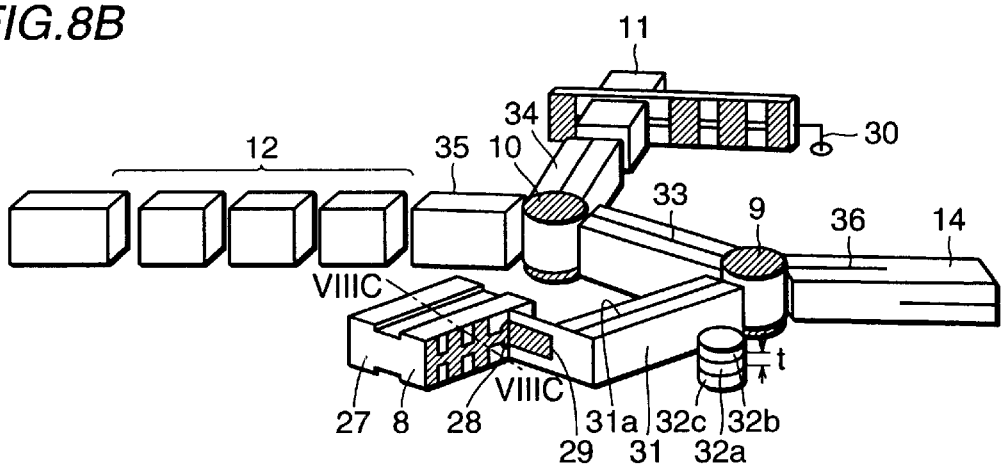

NRD guide transmitter 6 is specifically configured as shown in the FIG. 8A plan view and FIG. 8B three-dimensional view. In the figures, those components corresponding to those shown in FIG. 1 are denoted by the same reference characters.

Figure 9:
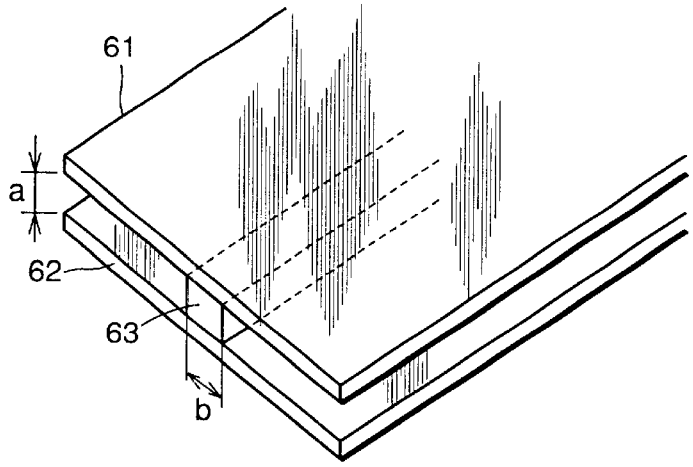
FIG. 9 illustrates a configuration of an NRD guide.

It is known that an NRD guide configured of a bellow cutoff parallel plate waveguide with a rectangular dielectric strip inserted therein can be advantageously used as a transmission line for transmitting a millimeter-wave, such as the 35 GHz band, the 60 GHz band, as in the present invention. As shown in FIG. 9, an NRD guide includes upper and lower conductive plates 61 and 62 formed of a satisfactorily conductive, non-magnetic material, such as aluminum, copper, brass, of approximately 4.0 mm in thickness and arranged in parallel and vertically spaced as predetermined, and a dielectric strip 63 provided in the form of a rectangular rod of a height a and a width b between upper and lower conductive plates 61 and 62. If dielectric strip 63 is of a dielectric which has a dielectric constant of no more than 3.0, such as Teflon, polyethylene, polystyrene, respectively having dielectric constants of 2.04, 2.1, 2.56, providing a small loss for a RF wave such as a millimeter-wave, and $\lambda_0$ represents a free space wavelength of a radio-frequency, then dielectric strip line 63 has height a and width b as follows:

$$a \approx 0.45\lambda_0$$

$$b = 0.51/\sqrt{\in_r^{-1}}\lambda_0,$$

wherein $\in_r$ represents the dielectric constant of the strip line. For the 60 GHz band a dielectric strip formed of Teflon has height a=2.25 mm and width b=2.5 mm and a single mode operation band is obtained from 55 GHz to 65.5 GHz.

Figure 8C:
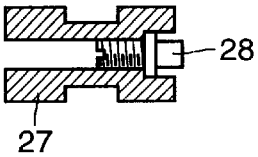
FIG. 8C is a cross section of a configuration of Gunn diode 28 and a metal piece 27 taken along line VIIIC—VIIIC of FIG. 8B.

NRD guide transmitter 6 of the present invention is configured using the NRD guide described above. Referring to FIG. 8C, a Gunn diode 28 having an H-shaped cross section is enclosed in a cylindrical porcelain package and mounted on a side surface of a metal piece 27 of brass provided with a $\lambda/4$ step lowpass filter. Gunn diode 28 is mounted sideways in NRD guide 31 between upper and lower conductive plates.

When a bias voltage is applied to Gunn diode 28 via a microstrip lowpass filter line of a $\lambda/4$ choke pattern etched in a 0.13 mm-thick Teflon substrate attached on metal piece 27, Gunn diode oscillator 8 outputs an oscillation frequency of the 60 GHz band.

Referring to FIGS. 8A and 8B, the oscillating signal is guided to an NRD guide 31 via a metal strip resonator 29 having a Teflon substrate with a metal strip. In metal strip resonator 29, the metal strip's width c and length d and the Teflon substrate's thickness e can determine its oscillating frequency. For example, when the Teflon substrate has a thickness e of 0.265 mm and the metal strip has a width c of 1.4 mm and a length d is varied from 1.5 mm to 2.5 mm, its oscillating frequency can be varied from 55 GHz to 63 GHz and a 60 GHz-band NRD guide's spectrum can be substantially covered and an oscillation output of no less than 130 mW can be obtained. In this example it is preferable to insert a mode suppressor 31*a* at an end of NRD guide 31 that contacts metal strip resonator 29, so as to suppress an unnecessary mode generated at a portion where they are coupled. Metal strip resonator 29, having the metal strip varied in length, is adjusted to a targeted frequency of the 59 GHz band. In the present embodiment it is adjusted to a frequency of 58.36 GHz or 59.15 GHz.

Near NRD guide 31 is side-coupled therewith a ceramic resonator 32 having a high Q for frequency stabilization. Ceramic resonator 32 operates, with the direction of the spacing between the upper and lower conductive plates as the resonator length, to contemplate frequency stabilization. Referring to FIG. 8B, ceramic resonator 32 is configured of a ceramic disc 32*a* of high Q and Teflon discs 32*b* and 32*c* sandwiching ceramic disc 32*a,* and ceramic disc 32*a* is positioned between and spaced equally from the upper and lower conductive plates to eliminate radiation. When ceramic disc 32*a* has a thickness t reduced, the resonator length can be reduced to provide a higher resonance frequency. For a thickness t of 0.47 mm, a resonance frequency of 59 GHr was obtained. In the present embodiment, ceramic resonator 32 is set to have a distance g of 1.35 mm from NRD guide 31 and provide a standing-wave ratio of 2.

An oscillating signal input to NRD guide 31 is guided by circulators 9, 10, for NRD guides to upconverter 11 and input thereto. An NRD guide 33 is inserted between circulators 9 and 10 for NRD guides and an NRD guide 34 is inserted between circulator 10 for an NRD guide and upconverter 11 to connect circulators 9 and 10 and upconverter 11. When an oscillating signal output of 13 mW was provided in the configuration as described above, upconverter 11 received 11 dBm. It should be noted that the upconverter employs a schottky barrier diode.

Upconverter 11 receives via a terminal 30 the IF signal ASK-modulated by ASK/ PSK/FSK modulator 2 and converts its frequency. Upper and lower side-band signals converted in frequency are passed through circulator 10 and an NRD guide 35 to bandpass filter 12 which is a 3-pole Chebychev filter having a center frequency of 60.625 GHz, a bandwidth of 2 GHz and a 0.5 dB ripple. Bandpass filter 12 only passes and transmits the upper side-band signal to transmitting antenna 13, which in turn transmits a RF wave. When upconverter 11 outputs upper and lower side-band signals of 0dBm, bandpass filter 12 outputs an upper side-band signal of 0 dBm. The lower side-band signal, which cannot pass through bandpass filter 12, is reflected and guided by circulators 9, 10 through an NRD guide 36 to matched load 14 and absorbed there.

Figure 10A:
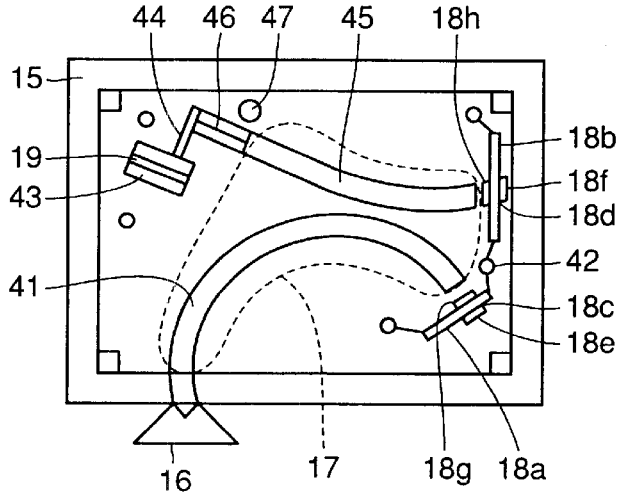
FIGS. 10A and 10B are a plan view and a three-dimensional view, respectively, of an NRD guide receiver 15.
Figure 10B:
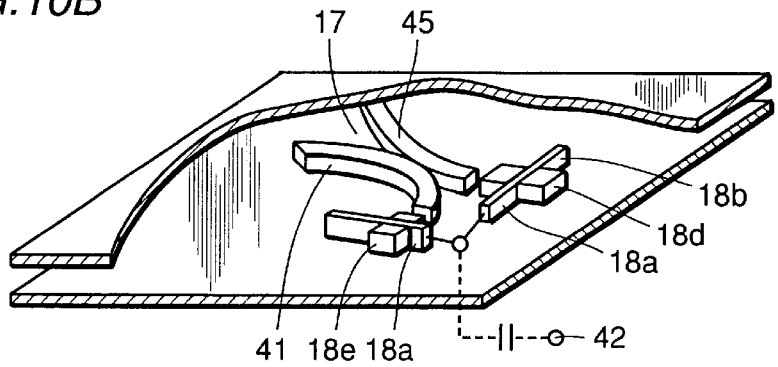

A specific configuration of NRD guide receiver 15 is shown in the plan view in FIG. 10A and the three-dimensional view in FIG. 10B. In the figures, those components corresponding to those shown in FIG. 1 are denoted by the same reference characters. An RF wave of the 60 GHz band received at receiving antenna 16 is divided in two via a 3 dB, NRD-guide directional coupler 17 configured of curved NRD guides 41, 45. For example, NRD guide 41 has a curvature r of 10 mm and a curving angle θ of 110° and NRD guide 45 has a curvature r of 43 mm. NRD guide 45 may be configured linearly. After the RF wave of the 60 GHz band is divided by NRD-guide directional couple 17 in two, they are introduced into balanced mixers 18*a,* 8*b,* respectively. In balanced mixers 18*a* and 18*b,* two schottky barrier diodes 18*c* and 18*d* are used to detect waves to enhance detection sensitivity. A Teflon piece 18*e* is attached on a front surface of a mount for schottky barrier diode 18*c* to protect it, and a Teflon piece 18*f* is also attached on a front surface of a mount for schottky barrier diode 18*d* to protect it. Furthermore, a high permittivity sheet is also attached on a rear surface of the mount for each of schottky barrier diodes 18*c* and 18*d* to achieve matching between low-resistance schottky barrier diodes 18*c* and 18*d* and high-impedance NRD guides 41 and 45. It should be noted that the high permittivity sheet has a thickness of $\lambda/4$. Furthermore, Teflon pieces 18*g,* 18*h* are each attached behind the high permittivity sheet to further enhance matching with the NRD guides.

An LO wave of 59 GHz from Gunn diode oscillator 19 is passed by NRD guide 45 and thus through NRD-guide directional coupler 17 to balanced mixer 18, which in turn downconverts the received signal and thus outputs the original IF signal at a terminal 42.

Gunn diode oscillator 19 in NRD guide receiver 15 is similar to Gunn diode oscillator 8 in NRD guide transmitter 6, having a Gunn diode mounted on a metal piece 43. An LO wave from Gunn diode oscillator 19 is passed via a metal strip resonator 44 and thus guide to NRD guide 45. Desirably, a mode suppressor 46 is inserted at an end of the NRD guide to suppress an unnecessary mode generated at a portion where the NRD guide and metal strip resonator 44 are coupled together. Near NRD guide 45 is side-coupled therewith a ceramic resonator 47 for frequency stabilization, as ceramic resonator 32 is in NRD guide transmitter 6. Ceramic resonator 47 operates, with the direction of the spacing between the upper and lower conductive plates as its resonator length, to contemplate frequency stabilization. Ceramic resonator 47 is configured of a ceramic disc of a high Q and Teflon discs vertically sandwiching the ceramic disc. The ceramic disc is also positioned between and spaced equally from the upper and lower conductive plates to eliminate radiation. The ceramic disc is adapted to have a thickness t of 0.47 mm and provide a resonance frequency of 59 GHz. Ceramic resonator 47 is set to have a distance of 1.35 mm from NRD guide 45 to provide a standing-wave ratio of 2.

NRD guide transmitter 6 and receiver 15 may have their respective ceramic resonators 32 and 47 with the ceramic disc substituted with alumina or the like and the Teflon discs substituted with polyethylene, polystyrene, boron nitride or the like. It may also have a shape other than a disc, i.e., an oval, a triangle or a square, although a disc resonator is easiest to manufacture. Furthermore, each ceramic resonator may have one of its upper and lower sides supported by a Teflon disc and the other side left unsupported such that the ceramic disc is positioned between and distant equally from the upper and lower conductive plates. In this example, preferably the ceramic disc has a dielectric constant which is closer to infinity.

Gunn diode oscillator 8 of NRD guide transmitter 6 and Gunn diode oscillator 19 of NRD guide receiver 15 are similarly configured, as described above, with a frequency-stabilizing, ceramic resonator provided adjacent to an NRD guide. A description will now be made of Gunn diode oscillator 8 of NRD guide transmitter 6. It should be noted, however, that the description applies to Gunn diode oscillator 19 of NRD guide receiver 15.

Figure 11:
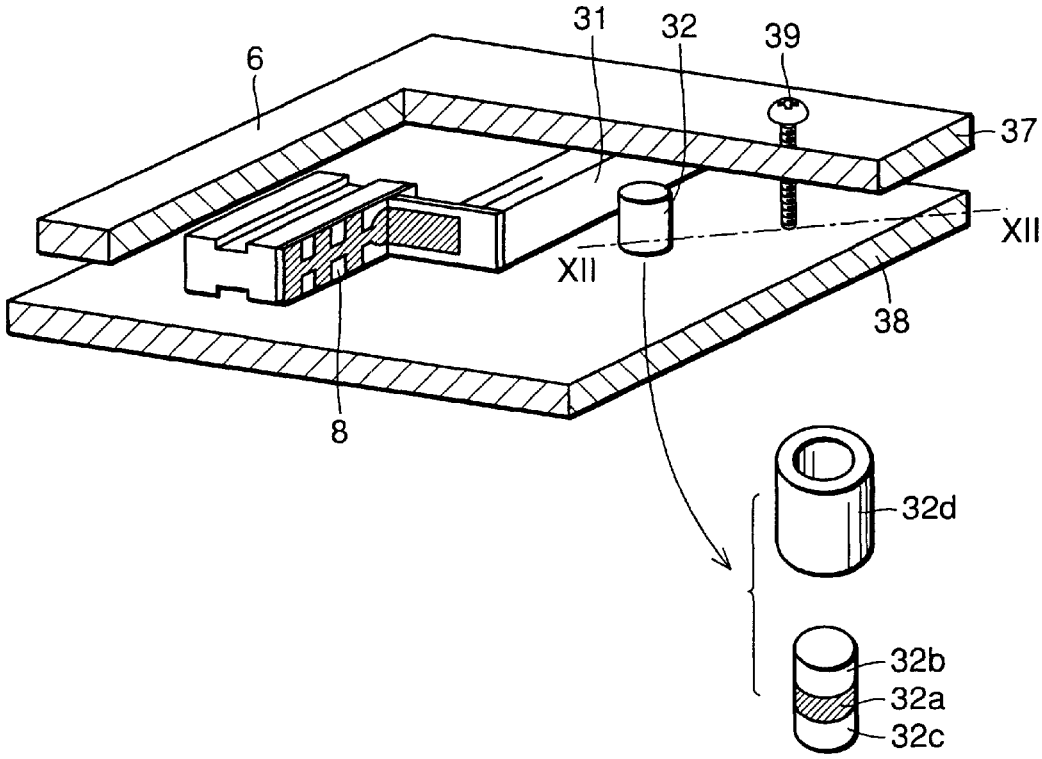
FIG. 11 is a partial perspective view of a frequency adjusting device of an NRD guide millimeter-wave Gunn oscillator.
Figure 12:
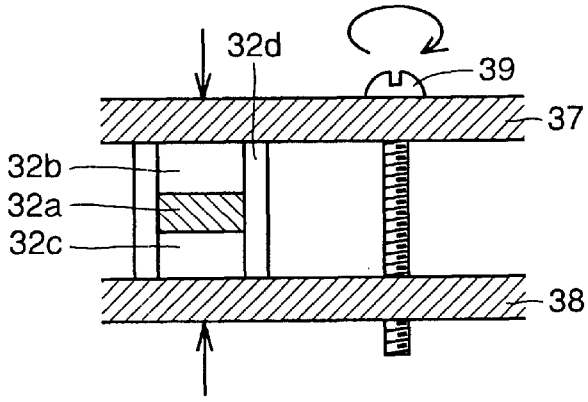
FIG. 12 is a cross section taken along line XII—XII of FIG. 11.

FIG. 11 is a three-dimensional view of NRD guide transmitter 6, particularly Gunn diode oscillator 8, NRD guide 31, ceramic resonator 32 and therearound, and FIG. 12 is a cross section taken along line XII—XII. Gunn diode oscillator 8 is configured of a self injection locked NRD Gunn oscillator capable of varying and controlling an oscillation frequency with a precision of several KHz.

As has been described above, ceramic resonator 32 is configured of ceramic disc 32*a* and Teflon discs 32*b* and 32*c* vertically sandwiching ceramic disc 32*a*. Ceramic disc 32*a* is formed of a relatively hard dielectric having a high Q, and Teflon discs 32*b*, 32*c* are formed of a soft dielectric lower in dielectric constant than ceramic. Ceramic resonator 32 is located with ceramic disc 32*a* positioned between and spaced equally from the upper and lower conductive plates. Ceramic resonator 32 is provided in the form of a disc and peripherally covered by a Teflon tube 32*d* provided in the form of a ling of a dielectric having a low dielectric constant. Teflon tube 32*d* prevents ceramic resonator 32 from deforming and also being affected by moisture resulting from dew formation in the NRD guide transmitter and receiver. Ceramic resonator 32 has a resonant frequency determined depending on a spacing between the upper and lower conductive plates wherein the resonator length is a spacing between the upper and lower conductive plates including its thickness t, and it resonates at a frequency for which the spacing is electrically a multiple of the half-wave length. Since ceramic resonator 32 resonates in the propagation mode $TE_{02\delta}$, when ceramic disc 32*a* is reduced in thickness its resonant frequency can be increased. While the height of ceramic resonator 32 is adjusted to a spacing of 2.25 mm between the upper and lower conductive plates, ceramic disc 32*a* and Teflon discs 32*b* and 32*c* are decreased and increased, respectively, in thickness to adjust its resonant frequency. Ceramic disc 32*a* is adapted to have a thickness of 0.47 mm to obtain a resonant frequency of the 59 GHz band.

Figure 13A:
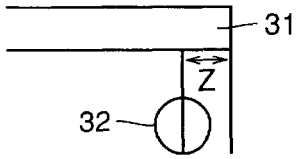
FIGS. 13A and 13B represent the oscillation frequency and output of an NRD guide Gunn oscillator with a ceramic resonator when as the position z of the ceramic resonator varies.
Figure 13B:
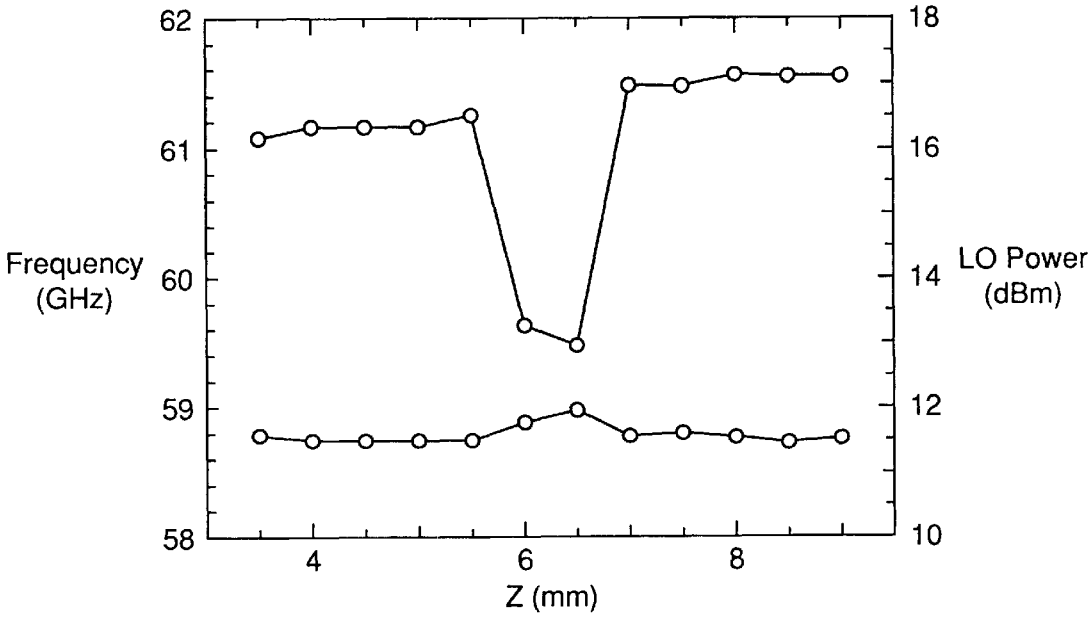

Ceramic resonator 32 has a distance g from NRD guide 31 such that it provides a standing-wave ratio of 2. Herein, g=1.35 mm. Ceramic resonator 32 also has a distance z from its center to an end surface of the mode suppressor of NRD guide 31, as shown in FIG. 13A, so that ceramic resonator 32 is locked. FIG. 13B represents the ceramic resonator's frequency and output varying with distance z. Referring to FIG. 13B, ceramic resonator 32 is locked at 6.0 mm and 6.5 mm. With ceramic resonator 32 locked, even when a spectrum analyzer's frequency axis (SPAN) is 50 kHz any variation was not observed in the oscillation frequency nor was the waveform disturbed. A phase noise of −110 dBc/Hz was also introduced, with a 1-MHz offset.

Referring again to FIG. 12, a screw 39 penetrating upper and lower conductive plates 37 and 38 is provided in a vicinity of ceramic resonator 32. The screw is provided at a position which allows a resonant electromagnetic field to be negligibly reduced. Since an electromagnetic-field distribution of a ceramic resonator in its radial direction damps with variation of $e^{-pr}$ wherein r (in meters) represents the coordinate in the radial direction and p (in Np/m) represents a lateral evanescent decay constant analyzed based on the theory of electromagnetic field, in general the screw is set at such a distance r that the ceramic resonator's radial electromagnetic field decays so that $8.686\ pr \geqq 30$ dB. In the present embodiment, screw 39 is arranged, crossing a line extending from NRD guide 31 and crossing ceramic resonator 32 orthogonally. Desirably, a nut is provided at an outer side of lower conductive plate 38 to firmly clamp it.

When screw 39 is turned with a driver or the like, a spacing between upper and lower conductive plates 37 and 38 can vary in a vicinity of ceramic resonator 32 to control an oscillation frequency with a precision of several KHz. More specifically, when the spacing between the upper and lower conductive plates is varied, the resonator length of ceramic resonator 32 also varies, while ceramic disc 32*a* has a resonant frequency significantly varied with its thickness due to its high dielectric constant and, in contrast, Teflon disc 32*b*, 32*c* has a resonant frequency varied a little with its thickness, since Teflon disc 32*b*, 32*c* has a low dielectric constant and ceramic disc 32*a* has therein a resonant electromagnetic field decayed exponentially. Furthermore, since ceramic disc 32*a* is relatively hard and Teflon discs 32*b* and 32*c* are relatively soft, Teflon discs 32*b* and 32*c* significantly varies in thickness whereas ceramic disc 32*a* varies little in thickness. Thus, by monitoring the screw while turning it, an oscillation frequency can be adjusted to a desired frequency with the precision of several KHz. After the adjustment, a stopper for the screw is provided to prevent turning of the screw to avoid unnecessary frequency variations. Thus an IF frequency difference of several KHz can be achieved between NRD guide transmitter 6 and receiver 15 to reliably reproduce signals.

The screw may have any form that can adjust the spacing between the upper and lower conductive plates and thus be as effective as described above, such as a lever, a gear or other various structures. Desirably, a mechanism for adjusting the spacing between the upper and lower conductive plates is provided not only one but also the other side of ceramic resonator 32 to uniformly change the thickness of the ceramic resonator.

Description will now be made of NRD guide transmitter 6' with an incorporated digital modulator shown in FIG. 1B. It is NRD guide transmitter 6 with an incorporated upconverter shown in FIGS. 8A and 8B minus bandpass filter 12 and also has self-injection synchronous NRD guide Gunn oscillator 8 having an oscillation frequency set by ceramic resonator 32 to 60.5 GHz. When the schottky barrier diode configuring the upconverter does not receive any input at its IF terminal but receives a serial signal to be displayed at its bias voltage applying terminal, a portion 11 operates as a milimeter-wave ASK modulator. Accordingly, a milliwave directly ASK-modulated in portion 11 is guided via circulator 10 to transmitting antenna 13, and received by NRD guide transmitter 15, as has been described above.

As such, without the circuit significantly varied, simply inputting a serial signal to be displayed to the schottky barrier diode at either the IF terminal or the bias voltage applying terminal allows portion 11 to operate as an upconverter or a millimeter-wave ASK modulator. This indicates that NRD guide transmitters 6, 6' have a characteristic in terms of multifunctionality.

In place of a 2-terminal device such as a schottky barrier diode, such a 3-terminal device as shown in FIG. 4, e.g., an FET (field effect transistor), a HEMT (high electron mobility transistor), may be alternatively used to provide millimeter-wave ASK.

The IF signal obtained at terminal 42 of NRD guide receiver 15 is demodulated by ASK demodulator 202 to provide the original, serial signal to be displayed. The serial signal to be displayed, comprised of data to be displayed, a clock signal and a synchronizing signal, as described above, is converted into a parallel signal and displayed in liquid crystal display device 100 shown in FIG. 14.

Figure 14:
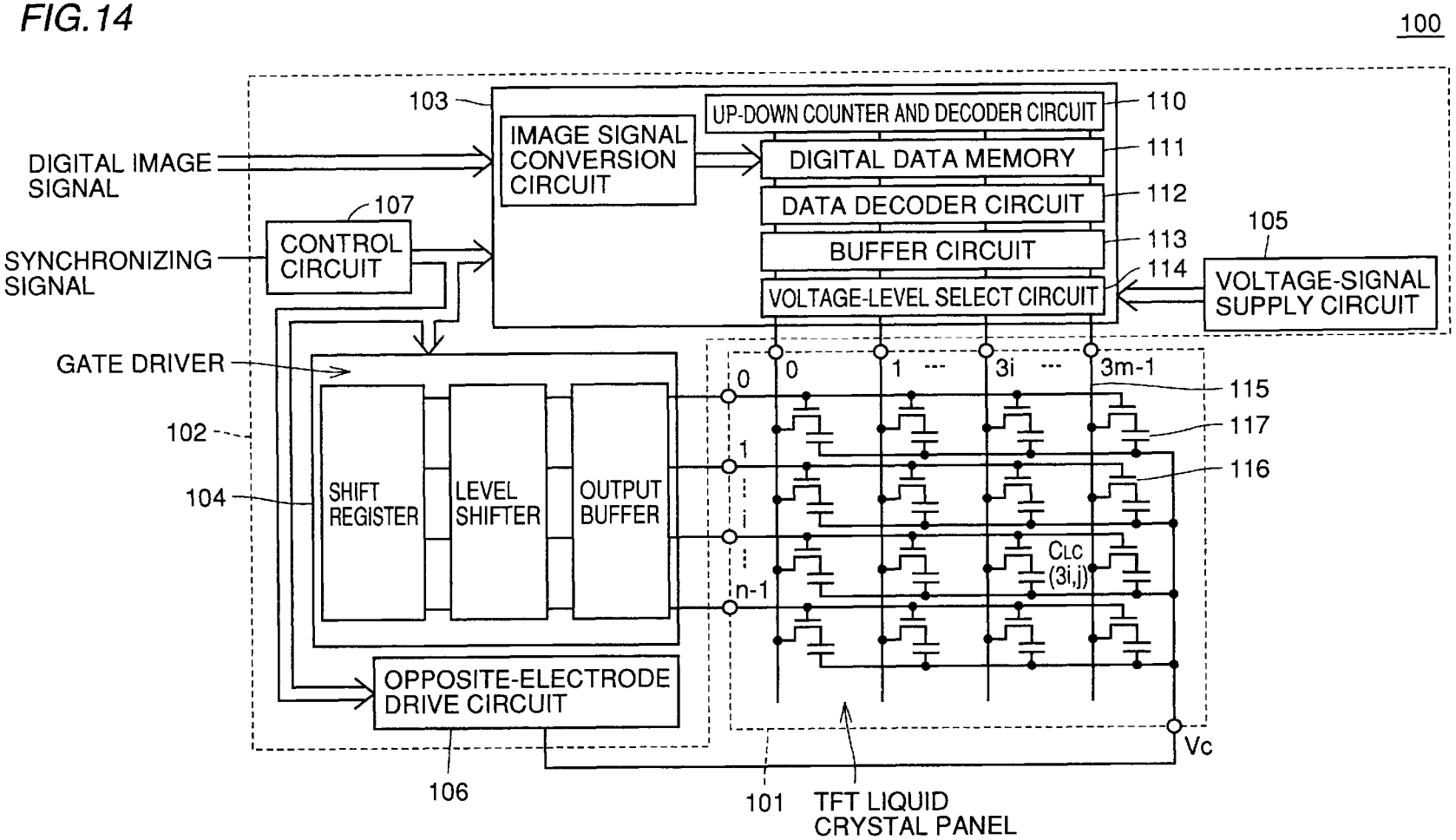
FIG. 14 shows a configuration of a liquid crystal display device.

Referring to FIG. 14, a liquid crystal display device 100 is comprised of a TFT liquid crystal panel 101 as a display unit serving as a display portion, and a drive circuit 102 including a data driver 103, a gate driver 104, a voltage-signal supply circuit 105, an opposite-electrode drive circuit 106 and a control circuit 107. Data driver 103 includes an up-down counter and decoder circuit 110, a digital data memory 111, a data decoder 112, a buffer circuit 113, and a voltage-level select circuit 114. Data driver 103 converts serial data into parallel data and supply a signal voltage to a signal line 115 of TFT liquid crystal panel 101 to drive a pixel 117 via TFT 116.

Figure 15:
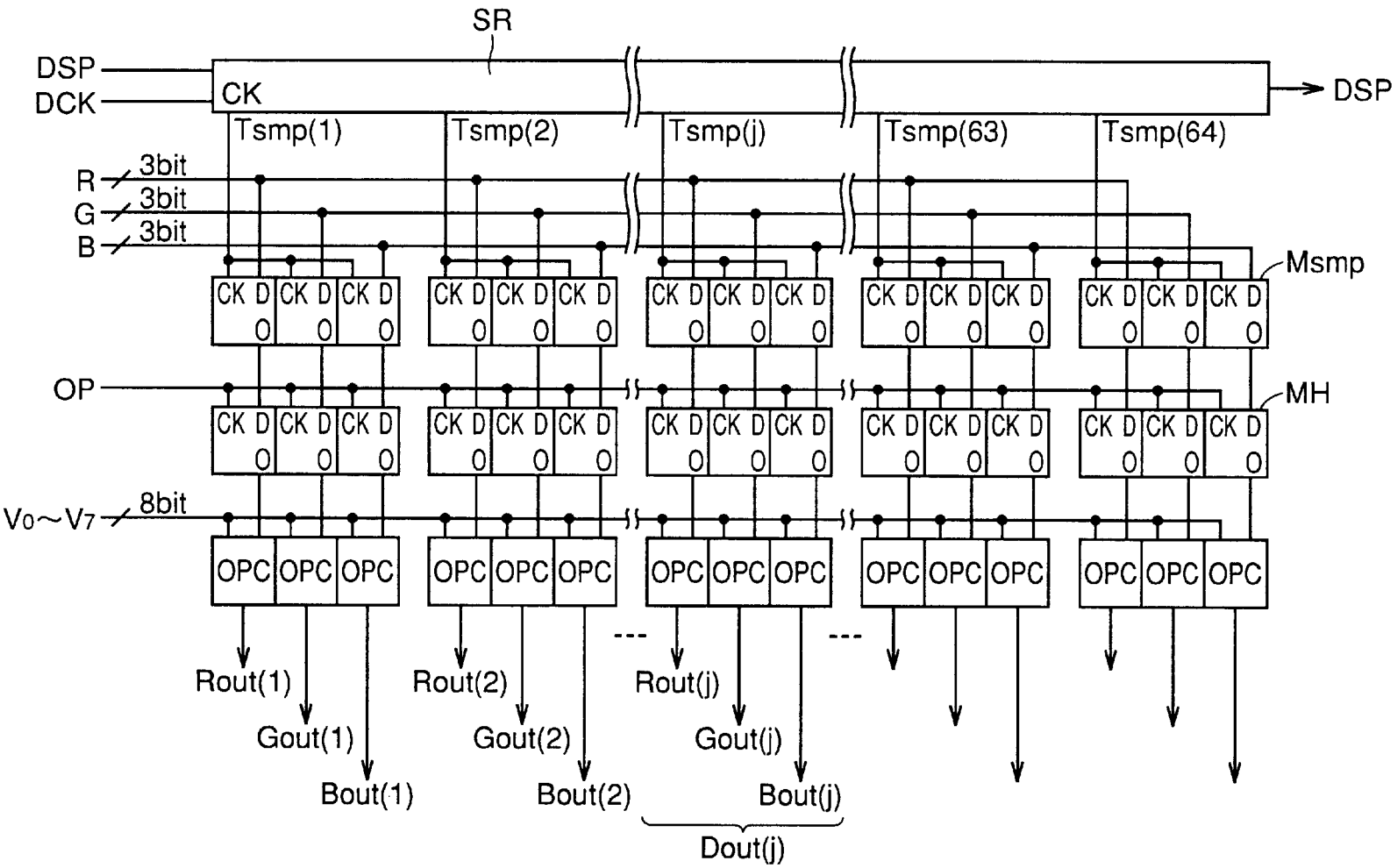
FIG. 15 shows a configuration of a data driver 103 of a liquid crystal display device.

FIG. 15 schematically shows a circuit configuration of data driver 103. Data driver 103 includes a shift register SR, a sampled-data storage circuit Msmp, an output holding circuit MH, and an output circuit OPC. Data driver 103 is controlled by the three signals of a data-sampling start pulse DSP, a clock signal DCK and an output pulse OP. Data-sampling start pulse DSP and clock signal DCK form a sampling pulse Tsmp output from shift register SR. In the figure, Rout (1), Gout (1), Bout (1) are data corresponding to the first picture element and Rout (2), Gout (2) Bout (2) are data corresponding to the second picture element.

As an example, for a flat display of the VGA specification (dot configuration: 640×480×RGB), there are 640 picture elements in the lateral direction and the data to be displayed of Rout (1), Gout (1), Bout (1) . . . Rout (640), Gout (640), Bout (640) are serially input to TFT liquid crystal panel 101.

Figure 16:
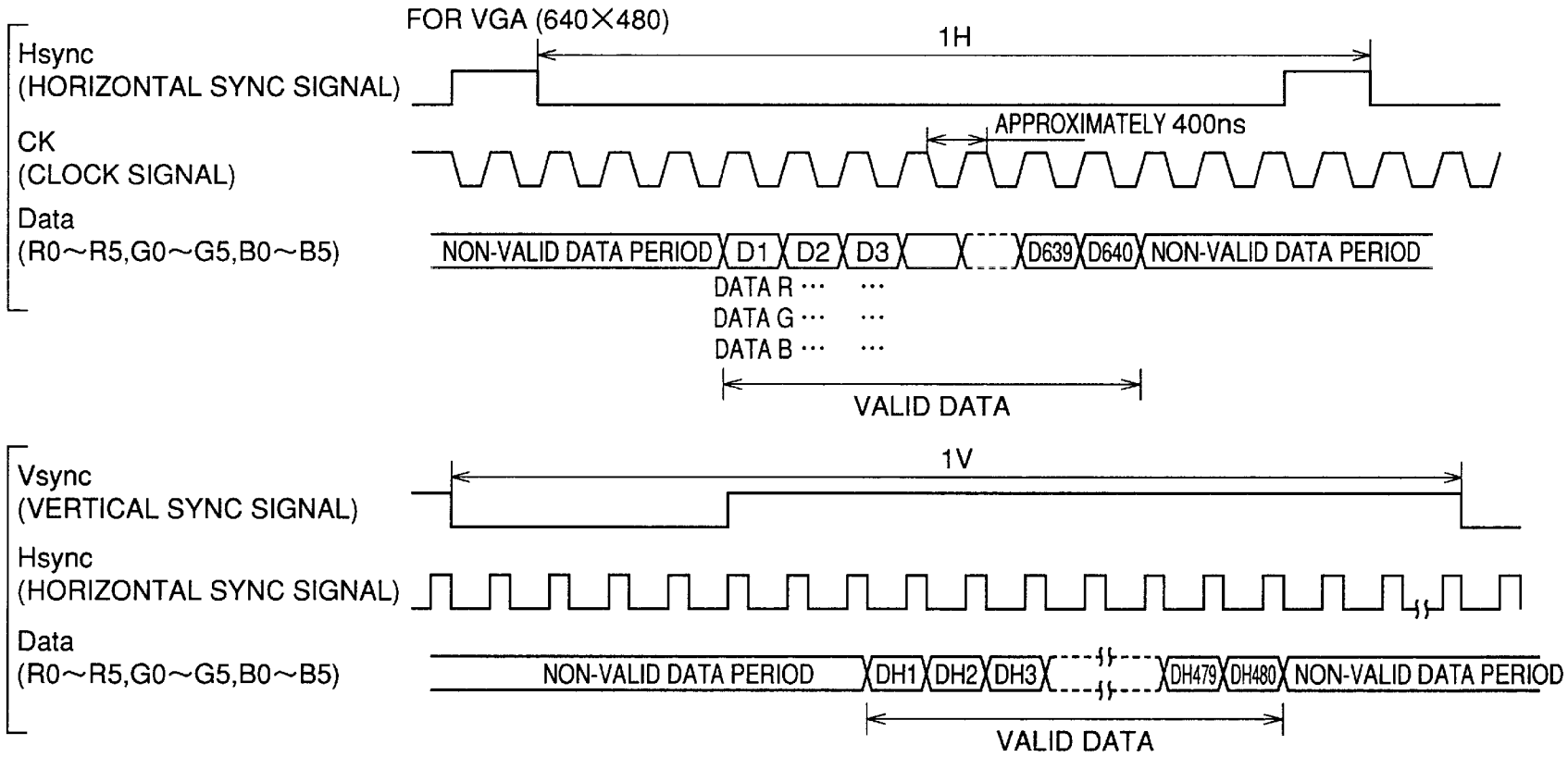
FIG. 16 is a timing diagram of a signal transmitted to a liquid crystal display device.

FIG. 16 represents transmission of binary digital data via a total of 18 signal lines of 6 bits×3 colors. In FIG. 16, Data represents data to be displayed, collectively representing data R, G, B of red, blue and green colors. Furthermore, D1 and D640 denote the respective periods during which the first and 640th data to be displayed in the horizontal direction are output, respectively, and DH1 and DH480 denote the respective periods during which the first and 480th data to be displayed in the vertical direction are output, respectively.

Figure 17:
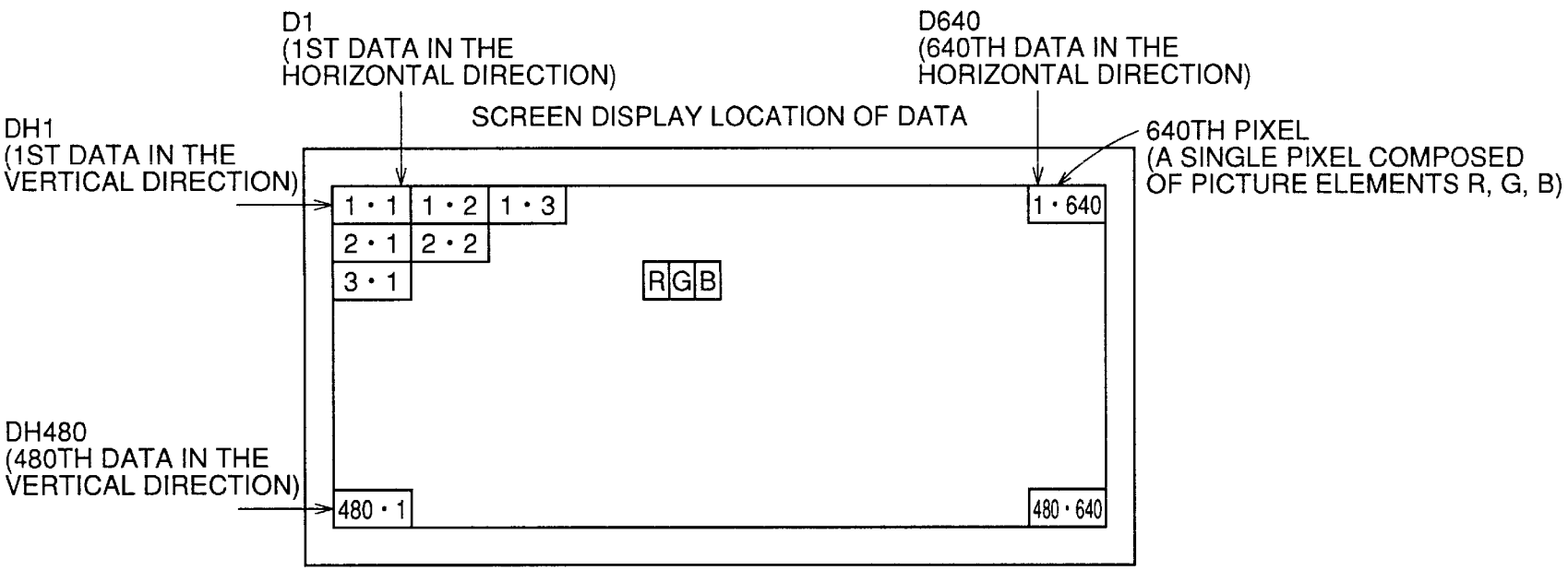
FIG. 17 represents an input signal (data to be displayed) and a display on a screen.

In FIG. 16, data in a valid data period is sampled in response to clock signal DCK to allow multi-color display at display portion 100. Thus, 640 pixels (a set of data R, G, B for one pixel) in the horizontal direction and 480 pixels in the vertical direction, i.e., a total of 307200 pixels can be displayed, as shown in FIG. 17.

Second Embodiment

Figure 18A:
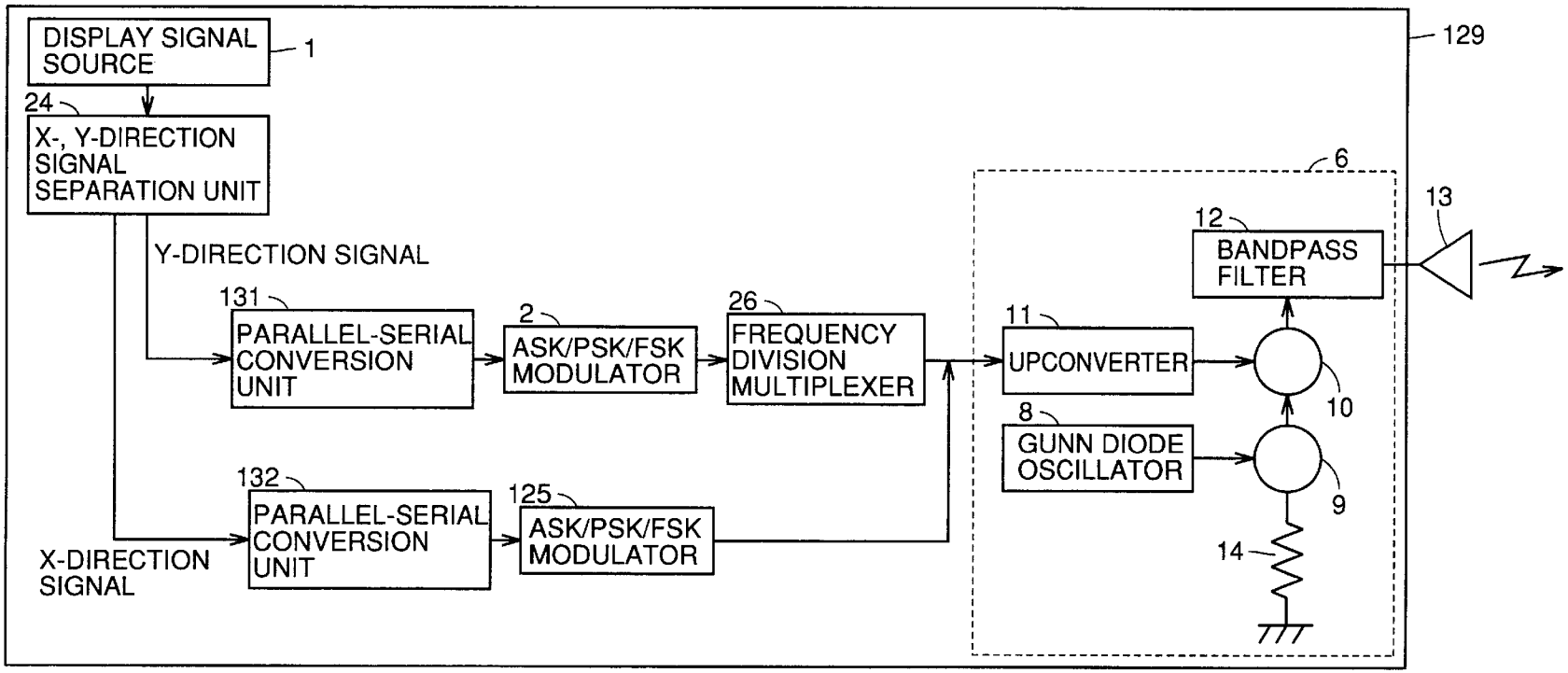
FIGS. 18A–18C are block diagrams showing a configuration of a flat display drive device of a second embodiment of the present invention.
Figure 18B:
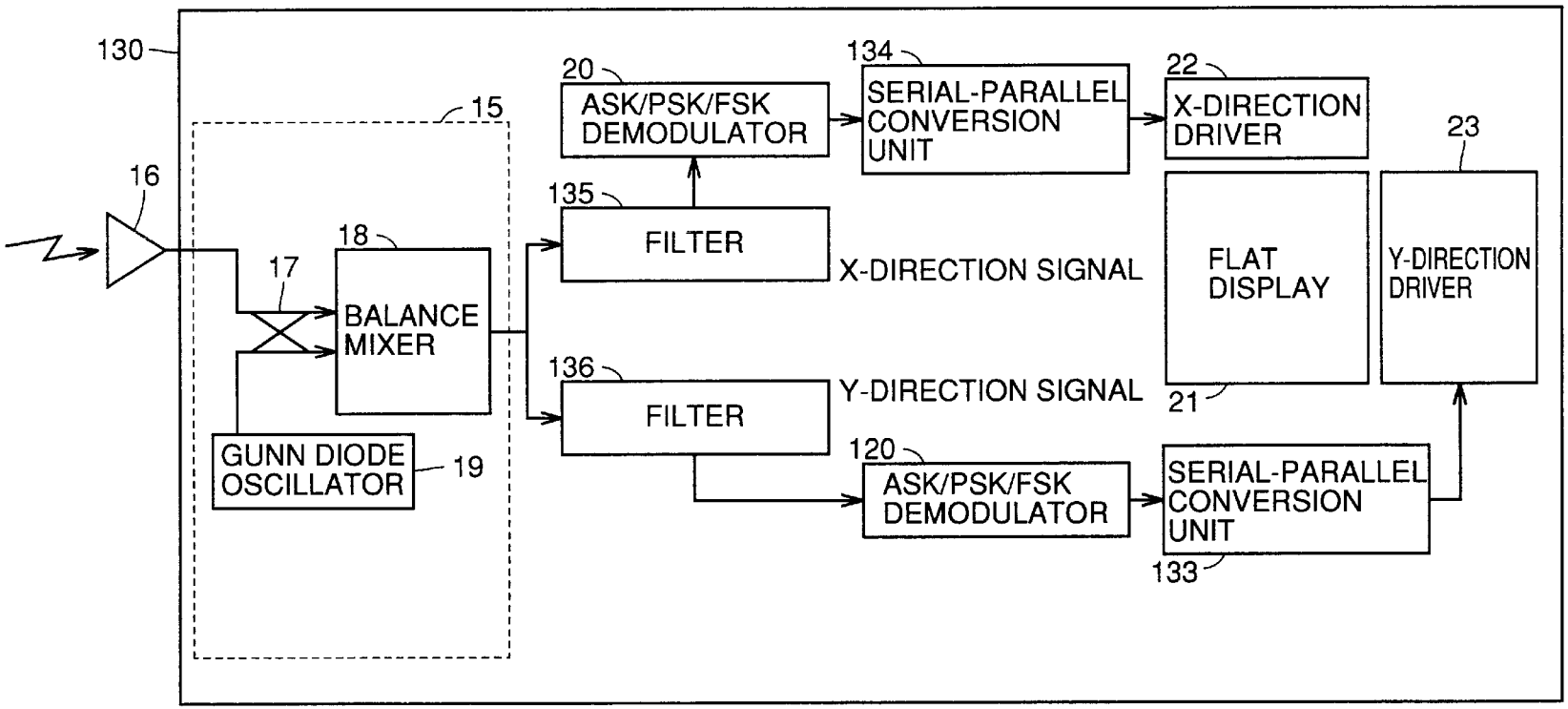

FIGS. 18A and 18B are block diagrams showing a configuration of a flat display drive device of a second embodiment of the present invention. The flat display drive device of the second embodiment includes a display drive signal transmission circuit 129 shown in FIG. 18A and a display drive device 130 shown in FIG. 18B. Referring to FIG. 18A, display drive signal transmission circuit 129 includes a display signal source 1, x- and y-direction signals separation unit 24, a parallel-serial conversion unit 131, a parallel-serial conversion unit 132, an ASK/PSK/FSK modulator 2, an ASK/PSK/FSK modulator 125, a frequency division multiplexer 26, an NRD-guide transmitter 6, and a transmitting antenna 13. NRD-guide transmitter 6 includes a Gunn diode oscillator 8, circulators 9, 10 for NRD guides, an upconverter 11, a bandpass filter 12, a matched load 14. Referring to FIG. 18B, display drive circuit 130 includes an NRD-guide receiver 15, a receiving antenna 16, a filter 135, a filter 136, an ASK/PSK/FSK demodulator 20, an ASK/PSK/FSK demodulator 28, a serial-parallel conversion unit 133, a serial-parallel conversion unit 134, a flat display 21, an x-direction driver 22, and a y-direction diver 23. NRD-guide receiver 15 includes an NRD-guide directional coupler 17, a balanced mixer 18, and a Gunn diode oscillator 19.

Description will now be made of the difference between flat display drive device 1000 of the first embodiment and the present embodiment.

In flat display drive device 1000 of the first embodiment, the signals output from display signal source 1 are, as shown in FIG. 2, data to be displayed comprised of red-, green- and blue-color data R, G and B defining red-, green- and blue-color components, respectively, and a clock signal and a synchronizing signal. As has been described above, the signals are received by NRD-guide receiver 15 and demodulated by ASK/PSK/FSK demodulator 20 and then converted by data driver 103 of FIG. 14 into a parallel signal to drive TFT liquid crystal panel 101.

In contrast, display drive signal transmission circuit 129 of the second embodiment further includes x- and y-direction signal separation unit 24 which receives from display signal source 1 and separates data to be displayed comprised of red-, green- and blue-color data R, G, B defining red-, green- and blue-color components, respectively, and a clock signal and a synchronizing signal into x- and y-direction signals capable of directly driving flat display 21. More specifically, this allows a signal output from display signal source 1 to correspond to signals respectively output from data driver 103 and gate driver 104 described with reference to FIG. 14, and the configuration of x-, y-direction signal separation unit 24 itself may be similar to that of data driver 103 and gate driver 104.

X- and y-direction signals output from x- and y-direction signal separation unit 24 are respectively converted into serial signals by parallel-serial conversion units 132 and 131 respectively associated with the x- and y-direction signals, and then ASK-, PSK- or FSK-modulated by similarly associated ASK/PSK/FSK demodulators 125 and 2. The modulation is not limited to ASK/PSK/FSK and may be any other appropriate modulation systems.

Frequency division multiplexer 26 shifts the frequency of a y-direction signal from a baseband to rearrange the y-direction signal on frequency axis. The y-direction signal output from frequency division multiplexer 26 is mixed with a modulated, x-direction signal. One example of such frequency arrangement is shown in FIGS. 19A–19D.

Figure 19A:
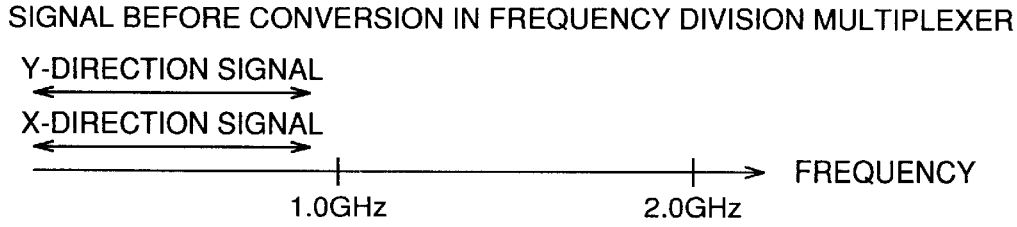
FIGS. 19A–19D represent an exemplary frequency arrangement when the flat display drive device of the second embodiment is used.

The FIG. 19A shows frequency arrangement of x- and y-direction signals before conversion in frequency division multiplexer 26. In FIG. 19A, these signals are set to have approximately the same frequency band. Normally, with the x- and y-directions respectively corresponding to data and gate drivers, an x-direction signal contains a larger amount of data than a y-direction signal and thus requires a wider frequency band than the y-direction signal. The FIG. 19A representation does not particularly limit bandwidth as represented and simply represents one exemplary arrangement on frequency axis.

Figure 19B:
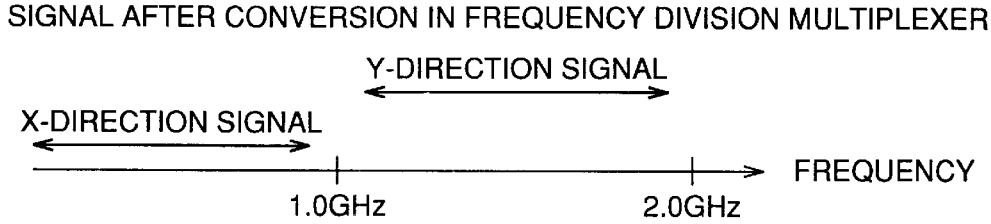
Figure 19C:
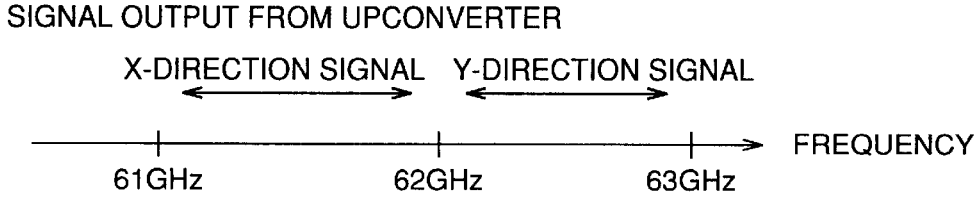
Figure 19D:
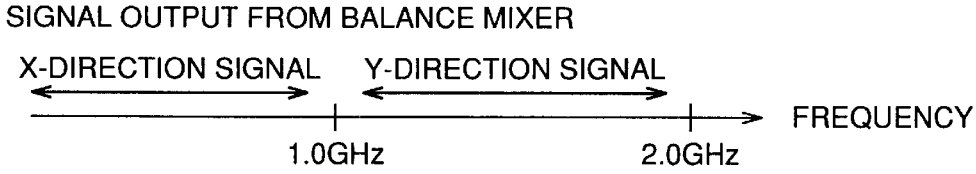

In the FIG. 19B, frequency division multiplexer 26 shifts the y-direction signal to a frequency band of no less than 1.0 GHz. Furthermore, upconverter 11 upconverts both of x- and y-direction signals to the 60 GHz band, as shown in FIG. 19C. Finally, balanced mixer 18 of display drive device 30 restores the x- and y-direction signals to the baseband and the 1 to 2 GHz band, respectively, as shown in FIG. 19D.

Figure 20:
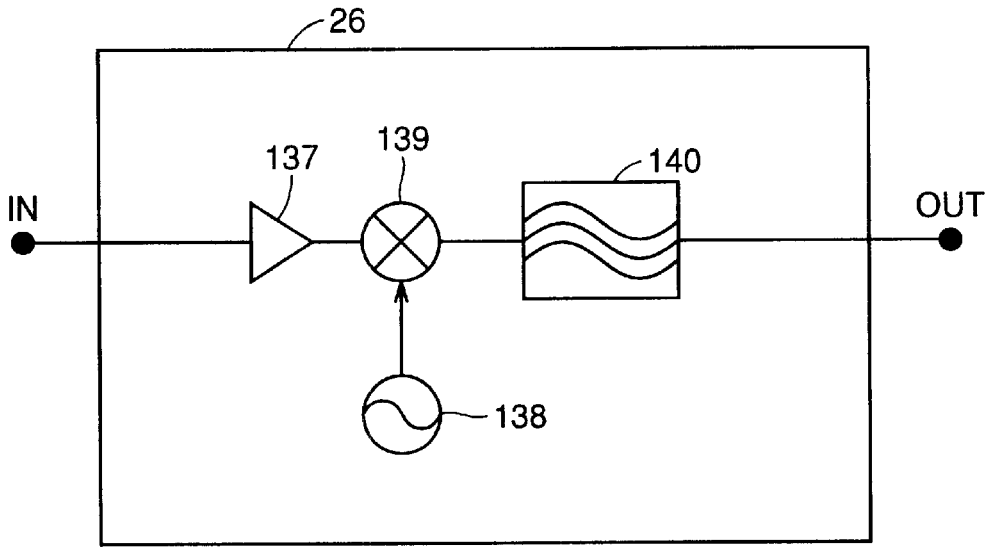
FIG. 20 is a block diagram showing one example of a frequency division multiplexer 26.

FIG. 20 is a block diagram showing an exemplary configuration of frequency division multiplexer 26. A signal input to frequency division multiplexer 26 is amplified by an amplifier 137 and then passed to frequency mixer 139 to be mixed with an oscillating output from a local oscillator 138. The mixture is passed to a filter 140 and a component with a shifted frequency is extracted thereby as an output signal.

In display drive circuit 130, a downconverted signal from balanced mixer 18 is separated by filters 135 and 136 into x- and y-direction signals, respectively, and demodulated by ASK/PSK/FSK demodulators 20 and 120. The demodulated, x-direction signal is converted by serial-parallel conversion unit 134 into a parallel signal which is supplied as data to be displayed to flat display 21 via x-direction driver 22. Similarly, the demodulated, y-direction signal is converted by serial-parallel conversion unit 133 into a parallel signal which is supplied as a gate signal to flat display 21 via y-direction driver 23.

As such, with x-direction driver 22 simply provided with voltage-level select circuit 114 of the circuit group included in data driver 103 shown in FIG. 14, a parallel signal from serial-parallel conversion unit 34 can drive flat display 21. In transmitting a same signal to a plurality of displays particularly in a TV conference system or the like, display drive device 130 having a simplified configuration is significantly effective in reducing the cost of the system, providing enhanced reliability and the like. As a display for household use also, the simplified configuration may enhance the reliability thereof.

Furthermore, since frequency separation is applied in the transmission from display drive signal transmission circuit 129 to display drive device 130, not only a signal to be displayed can be divided simply into x- and y-direction signals but also when a screen is enhanced in precision x- and y-direction signals that are both bisected may have one bisectional x- and y-direction signals and the other bisectional x- and y-direction signals both separated in frequency and then transmitted to readily ensure a sufficient transmission band.

Figure 18C:
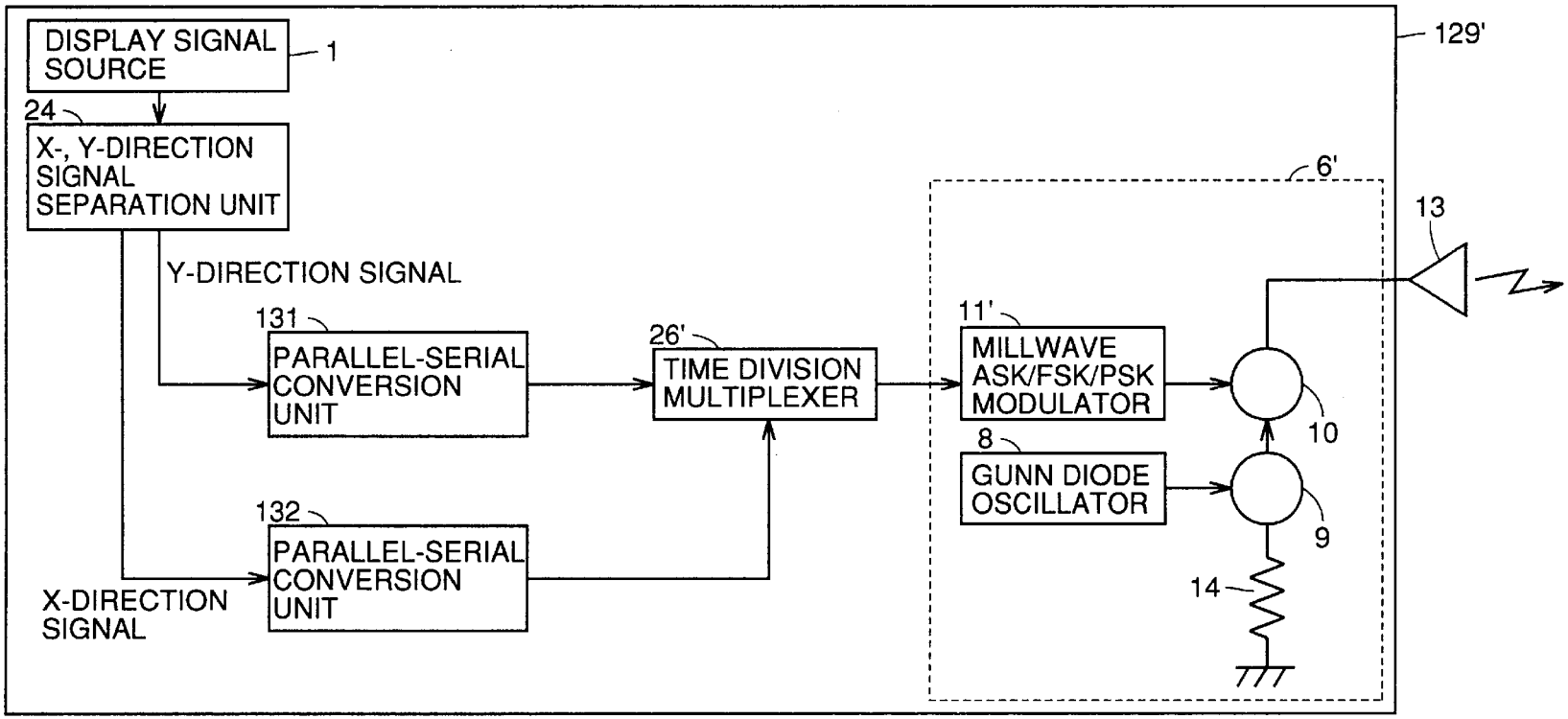

FIG. 18C is a block diagram showing a configuration of a display drive device 129', having NRD guide transmitter 6' with an incorporated digital modulator in place of NRD guide transmitter 6 with an incorporated upconverter of display drive device 129 shown in FIG. 17A. Display drive device 129' applies to a millimeter-wave ASK modulator a serial signal to be displayed which is obtained from a time-division multiplexer 26' replacing frequency division multiplexer 26 to time-division multiplex x-and y-direction signals to provide the serial signal.

In FIG. 18C, parallel-serial conversion units 131 and 132 convert y- and x-direction signals into serial signals, respectively, as has been described with reference to FIG. 18A, and time division multiplexer 26' converts the serial signals to one series of serial signal which is fed to a millimeter-wave ASK/PSK/FSK modulator 11' in NRD guide transmitter 6' with an incorporated digital modulator and modulated there in a millimeter-wave and then transmitted via transmitting antenna 13 to display drive device 130.

In display drive device 130, the received signal is demodulated by ASK/PSK/FSK demodulator 20 and converted by serial-parallel conversion unit 133 to parallel signals so that the x- and y-direction signals having been time-division multiplexed are also free of time-division multiplexing. The x- and y-direction signals separated in parallel are fed to x- and y-direction drivers 22 and 23 and thus displayed on flat display 21.

Third Embodiment

Figure 21A:
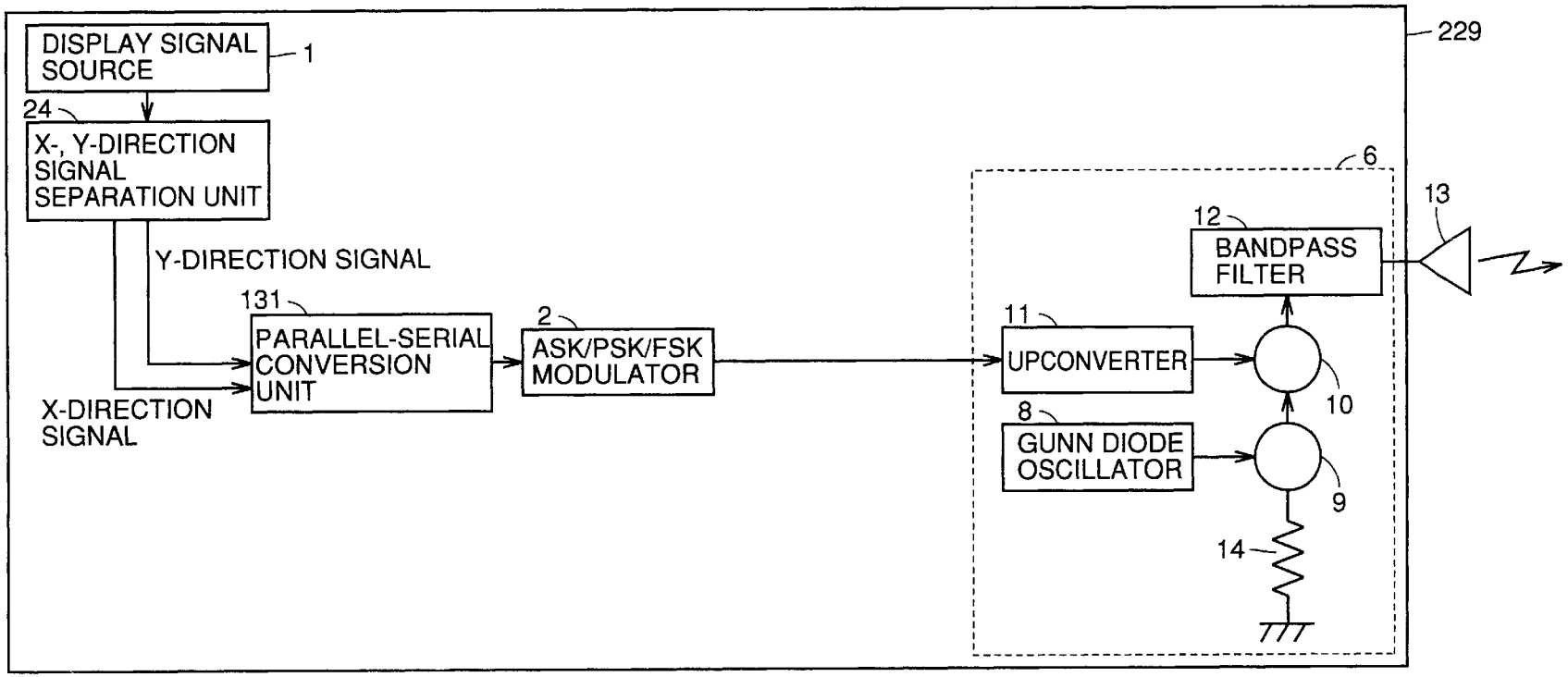
FIGS. 21A and 21B are block diagrams showing a configuration of a flat display drive device of a third embodiment of the present invention.
Figure 21B:
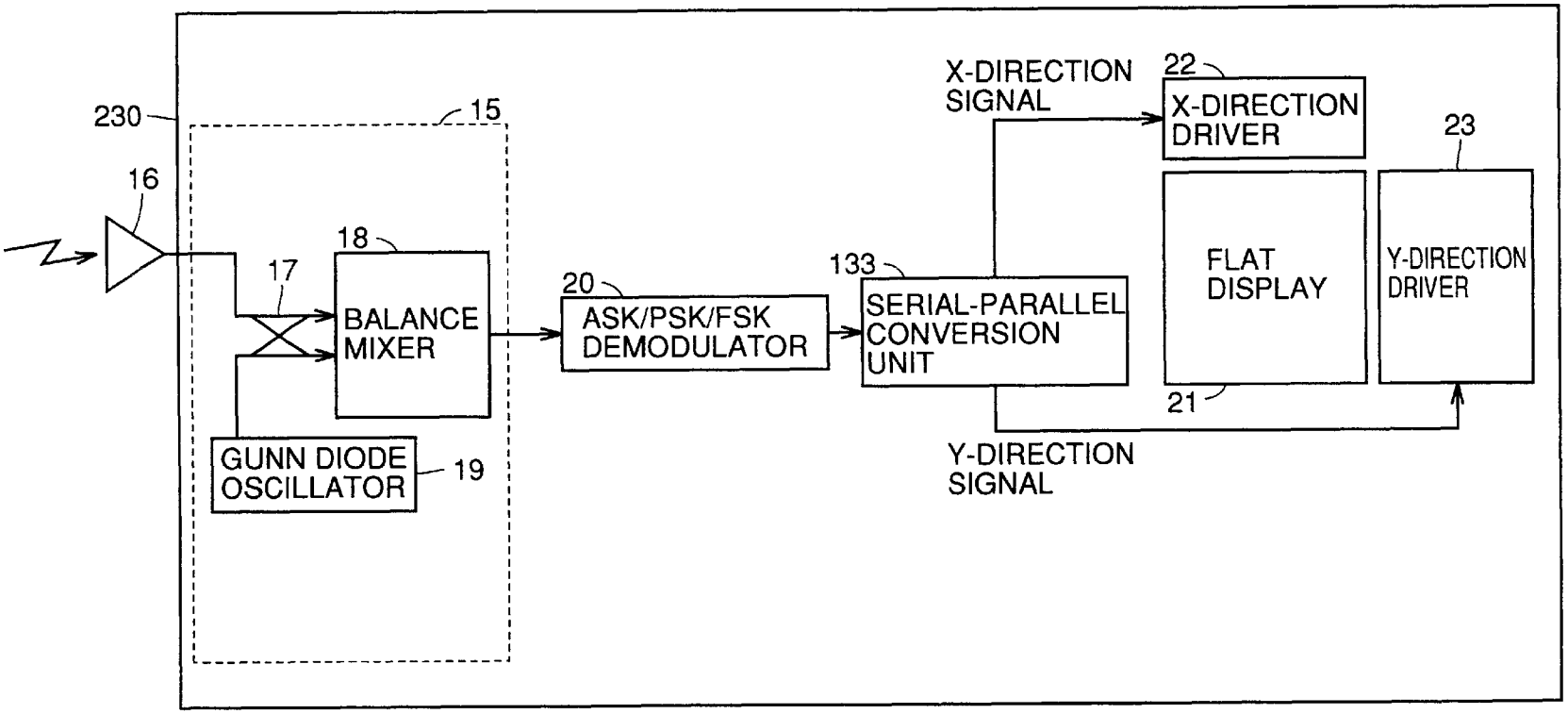

FIGS. 21A and 21B are block diagrams showing a configuration of a flat display drive device of a third embodiment of the present invention. The flat display drive device of the third embodiment includes the FIG. 21A display drive signal transmission circuit 229 and the FIG. 21B display drive circuit 230. The present embodiment does not use the x- and y-direction signal frequency separation applied in the flat display drive device of the second embodiment. In the present embodiment, display signal source 1 initially outputs data to be displayed comprised of red-, green-, blue-color data R, G, B, respectively defining red-, green-, blue-color components, and a clock signal and a synchronizing signal to x- and y-direction signal separation unit 24. X- and y-direction signal separation unit 24 separates the received data and signals into x- and y-direction signals capable of directly driving flat display 21. Parallel-serial conversion unit 131 receives and converts the x- and y-direction signals successively into a series of serial signals. The transmission of the serial signals requires a bandwidth larger than a bandwidth required for transmission of each of x and y-direction signals in the second embodiment. Depending on the precision of the screen, however, the serial signals can be transmitted in a single band if an appropriate transmission band that can be used is selected.

The converted serial signals are modulated by ASK/PSK/FSK modulator 2 and then transmitted as a signal of the 60 GHz band via NRD-guide transmitter 6, as in the first and second embodiments.

In display drive circuit 230, as in the first and second embodiments, the received signals are downconverted by NRD-guide receiver 15 to a baseband and demodulated by ASK/PSK/FSK demodulator 20. The demodulated signals are converted by serial-parallel conversion unit 133 into parallel signals. Of the parallel signals, an x-direction signal is applied to x-direction driver 22 and a y-direction signal to y-direction driver 23 to drive flat display 21.

Display drive device 230 of the present embodiment can be simpler in configuration than display drive device 130 of the second embodiment, although the former requires a single band of a larger width than the latter.

Figure 22:
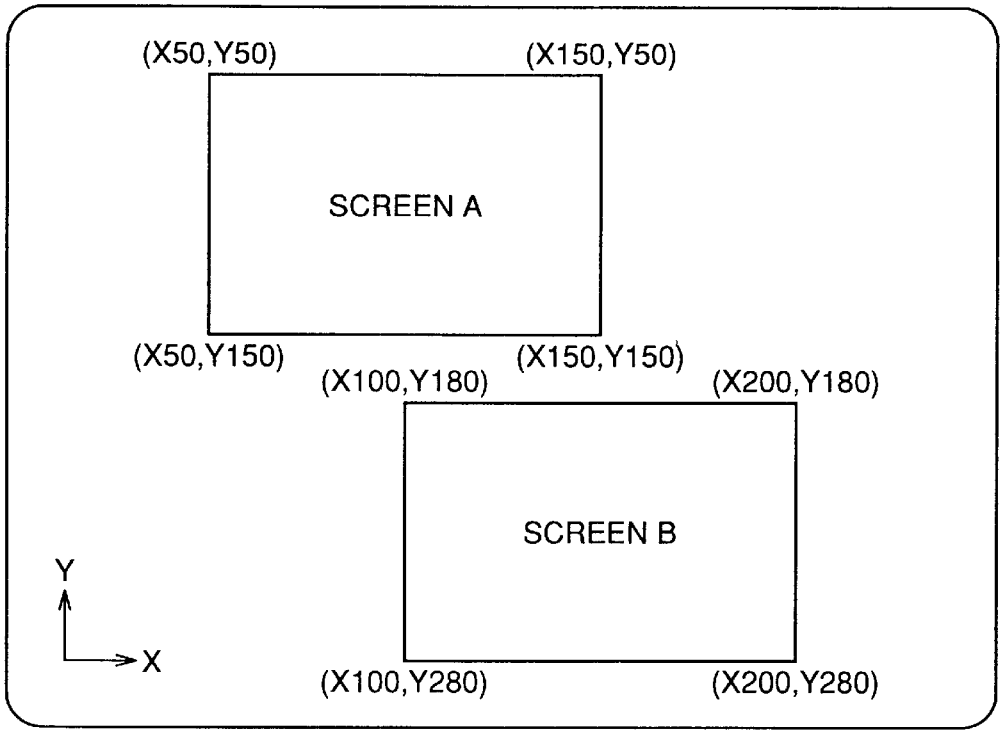
FIG. 22 is an exemplary screen display when the flat display drive device of the present invention is used to provide 2-screen display.

FIG. 22 shows an exemplary display when 2screen display is provided in the configurations of the second and third embodiments. Representations such as (X50, Y50) are displaying coordinates on the screen. The 2-screen display provided by the flat display drive device of the third embodiment is distinguished from that provided in a conventional TV receiver or the like in that x-, y-direction signal separation unit 24 of display drive signal transmission circuit 229 can directly control displaying coordinates on a display.

For example, for data to be displayed such as two types of video signals input to display signal source 1, if a screen A is displayed on displaying coordinates (X50, Y50) to (X150, Y150) and a screen B is displayed on displaying ordinates (X100, Y180) to (X200, Y280), for example, x- and y-direction signal separation unit 24 may extract from the data to be displayed from display signal source 1 only the data corresponding to the displaying coordinates (X50, Y50) to (Xl50, Y150) corresponding to screen A and the data corresponding to the displaying coordinates (X100, Y180) to (X200, Y280) corresponding to screen B and parallel-serial conversion unit 131 may convert the extracted data into serial signals and NRD transmitter 6 may upconvert the serial signals into the 60 GHz band and transmit the upconverted signals to display drive circuit 230.

Display drive circuit 230 may provide receive and drive operations without distinguishing between the signals. As such, while the flat display drive device of the third embodiment does not transmit data configuring the entire screen of flat display 21, flat display 21 can provide 2-screen display of the transmitted screens A and B, such as shown in FIG. 22. Furthermore, screen display is not limited to 2-screen display and the transmitting side may designates any location(s) on a screen to provide 1- or multi-type display. Alternatively, the dot information, bit map information and other information of a portion of a screen may be transmitted. Since an image can be displayed in a partial area of a screen without transmitting the data of the entire screen, a screen transmission can be achieved with a minimally occupied band.

Fourth Embodiment

Figure 23A:
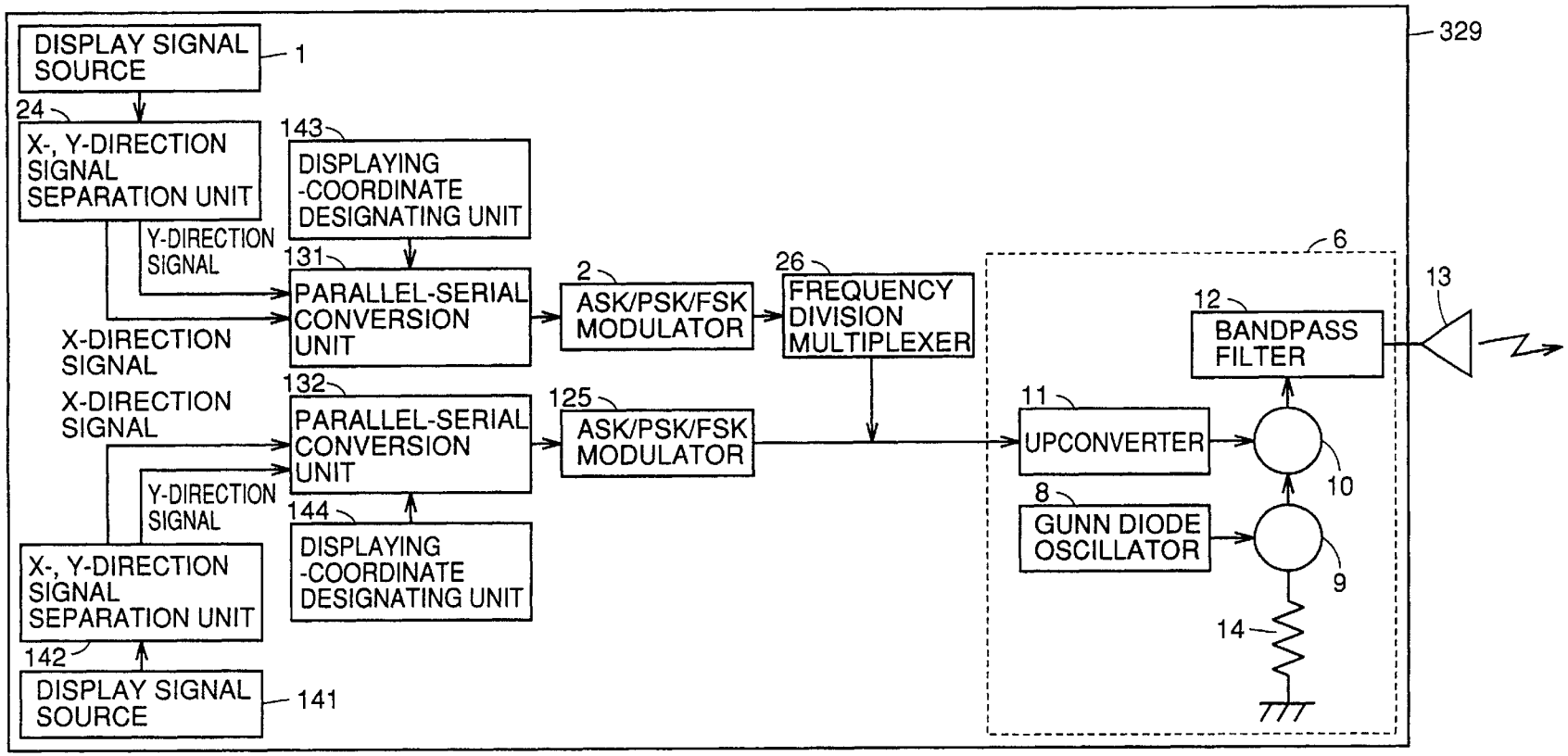
FIGS. 23A and 23B are block diagrams showing a configuration of a flat display drive device of a fourth embodiment of the present invention.
Figure 23B:
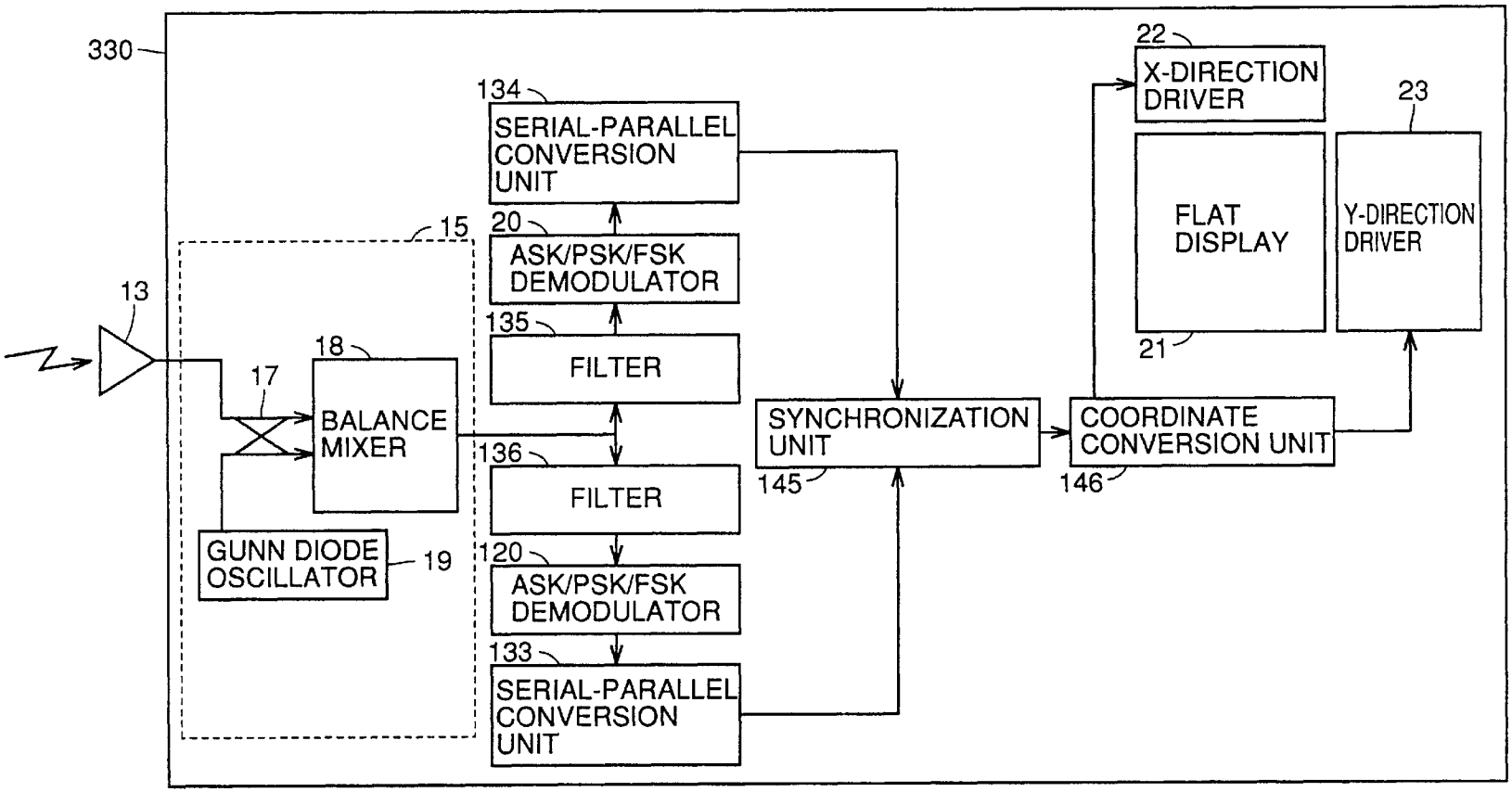

FIGS. 23A and 23B are block diagrams showing a configuration of a display drive device of a fourth embodiment of the present invention. The flat display drive device of the fourth embodiment includes the FIG. 23A display drive signal transmission circuit 329 and the FIG. 23B display drive circuit 330. In the flat display drive device of the fourth embodiment, display drive signal transmission circuit 329 can designates a screen display position, a screen display range and the like on that display 21 and allow display drive circuit 330 to provide a displaying in accordance with such designation. While in the present embodiment video signals of two screens from two display signal sources are displayed in a single screen, a display position of only one type of video signal can also be similarly designated. Alternatively, multi-screen display may also be provided, such as 9-screen display.

In the FIG. 23A display drive signal transmission circuit 329, two signals to be displayed received from display signal sources 1 and 141 are each separated into x- and y-direction signals and then respectively converted into serial signals by parallel-serial conversion units 131 and 132, respectively. Display drive signal transmission circuit 329 also includes displaying-coordinate designating units 143 and 144 each designating a displaying coordinate for a signal to be displayed on flat display 21. By way of example, display signal sources 1 and 141 correspond to screen A (e.g., a receiving screen of a TV receiver) and screen B (e.g., a reproducing screen of a VTR), respectively. In designating displaying-coordinates, upper right and lower right coordinates of a displaying range may be designated, a center point and size of a displaying may be designated, or an upper left coordinate and a size may be designated. Any other methods other than the above may also be used.

The signals indicating designated coordinates are input to parallel-serial conversion units 131 and 132, respectively and superimposed on the data to be displayed therein and then modulated in ASK/PSK/FSK modulators 2 and 125. An output from ASK/PSK/FSK modulator 2 is input to frequency division multiplexer 26 and therein sifted in frequency band, as described in the second embodiment, since, as has been described above, simultaneous transmission of two types of video signals requires a wide transmission band. Frequency division multiplexer 26 applies frequency arrangement, as shown in FIGS. 19A–19D.

In display drive circuit 330, received signals are down-converted by balanced mixer 18 and converted into parallel signals via filter 135, ASK/PSK/FSK demodulator 20 and serial-parallel conversion unit 134, and filter 136, ASK/PSK/FSK demodulator 120 and serial-parallel conversion unit 133, respectively. The data converted into the parallel signals are sent to a synchronization unit 145 to have a time difference in the demodulation corrected by synchronization unit 145 and the displaying-coordinate data superimposed on the parallel signals are used by a coordinate conversion unit 146 to provide displaying-coordinate conversion.

If the displaying-coordinate designation herein is similar to FIG. 22 screen, the x- and y-direction signals of screen A are converted as the data to be displayed of (X50, Y50) to (X150, Y150) and those of screen B as the data to be displayed of (X100, Y180) to (X200, Y280).

Fifth Embodiment

Figure 24A:
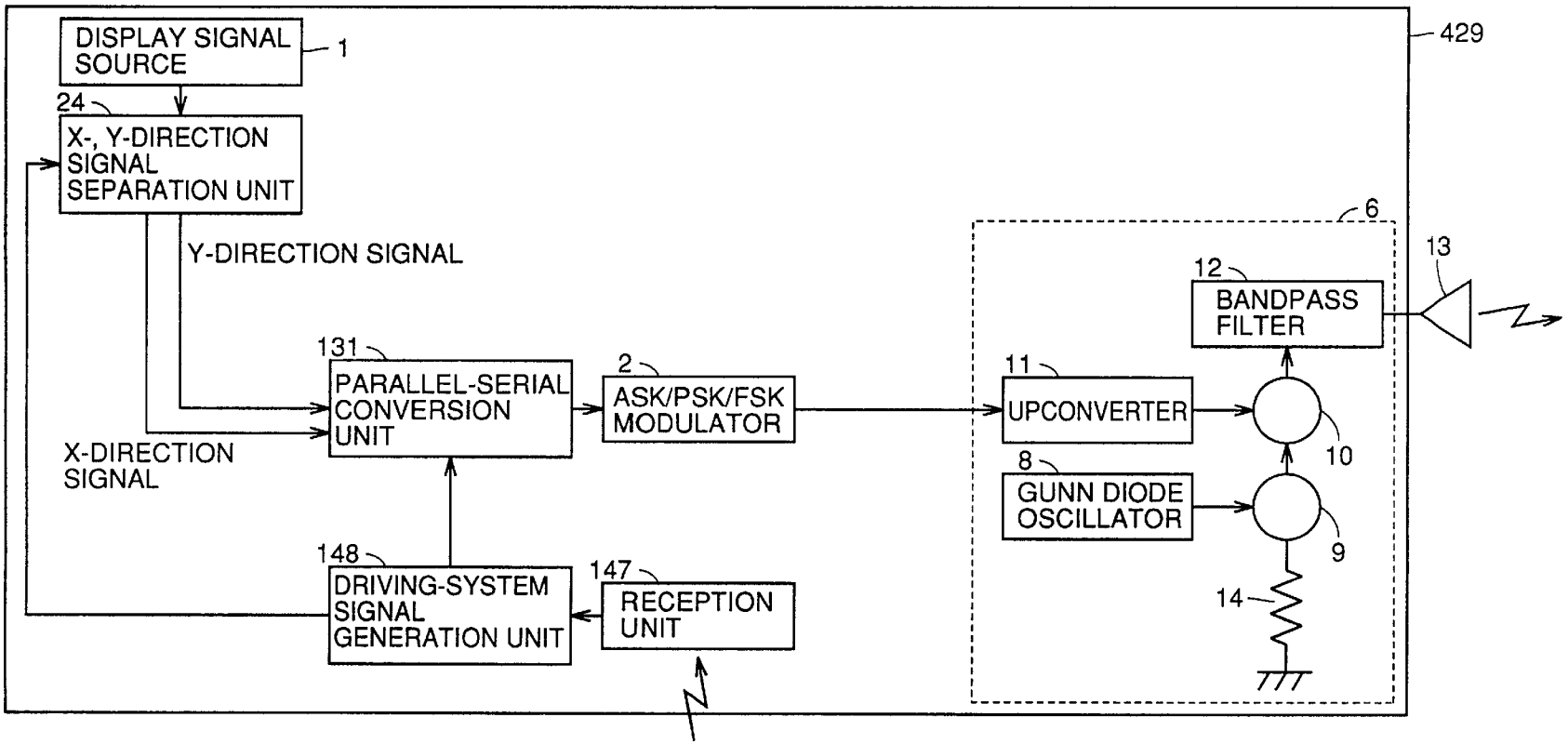
FIGS. 24A and 24B are block diagrams showing a configuration of a flat display drive device of a fifth embodiment of the present invention.
Figure 24B:
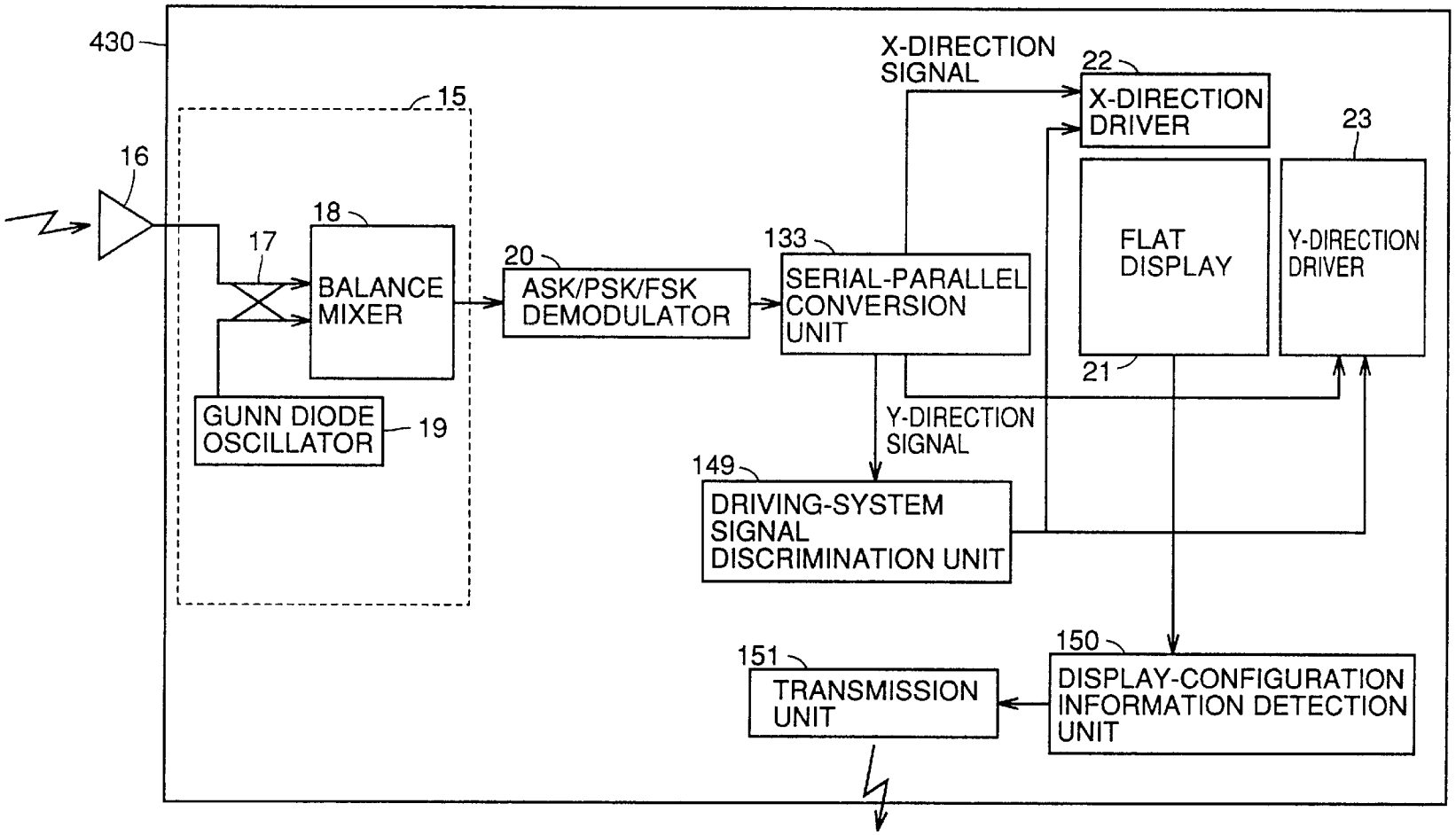

FIGS. 24A and 24B are block diagrams showing a configuration of a flat display drive device of a fifth embodiment of the present invention. The flat display drive device of the fifth embodiment includes the FIG. 24A display drive signal transmission circuit 429 and the FIG. 24B display drive circuit 430. The flat display drive device of the fifth embodiment allows either the transmitting side or the display side to change a system applied to drive a display. The flat display drive device of the fifth embodiment is that of the third embodiment shown in FIGS. 21A and 21B plus a reception unit 147, a driving-system signal generation unit 148, a driving-system signal discrimination unit 149, a detection unit disposed to detect the information on the display's configuration applied 150, and a transmission unit 151. Herein, by way of example, the display side transmits to the transmitting side the applicable configuration(s), restriction(s) and the like, e.g., of a system applied to drive the display, and depending on the performance of the display an appropriate driving method is automatically selected and transmitted.

Figure 25A:
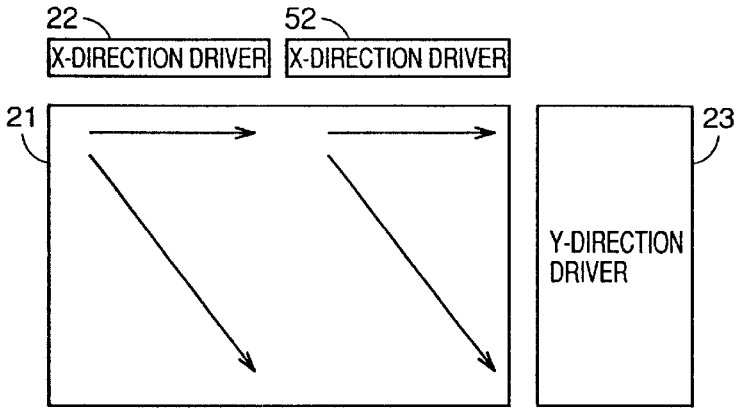
FIGS. 25A and 25B illustrate a method of driving a flat display, with its screen divided in two, right and left sides, via the flat display drive device of the present invention.
Figure 25B:
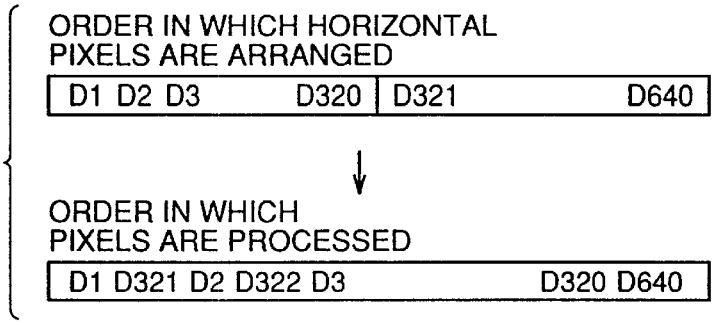

Referring to FIG. 24B, detection unit 150 detects the information on the configuration of flat display 21 or x- and y-direction drivers 22 and 23. For example, as shown in FIG. 25A, if flat display 21 has 640×480 pixels and the x-direction drive is bisected, configured of x-direction drivers 22 and 52, then the horizontal pixels bisected into pixels D1–D320 an pixels D321-D640 may have each two data, starting from the set of D1 and D321, processed simultaneously to enhance the driver's processing rate. The order in which the pixels are processed is D1, D321, D2, D322, . . . , D320, D640, as shown in FIG. 25B and the information for determining such driving systems are detected by detection unit 150.

While such information may be obtained via a circuit which checks the circuit configuration of flat display 21 or x- and y-direction drivers 22 and 23. Preferably, however, the data indicating standardized configuration information is previously stored in the display side to simplify the circuit. For example, the manufacturer of the display, the type of the display, the system applicable to drive the display and other information that are stored in a non-volatile memory may be detected by detection unit 150 via a standardized interface.

Referring to the FIG. 24B again, transmission unit 151 transmits the detected information on the configuration of the display to display drive signal transmission device 129. Transmission unit 151 may use infrared transmission including IrDA-Control, or wireless transmission, audio transmission, transmission through a wire or the like.

In display drive signal transmission circuit 429, reception unit 147 receives the information on the configuration of the display, which is transmitted via driving-system signal generation unit 148 and used to change the arrangement of x- and y- signals in x- and y-direction signal separation unit 24. Such arrangement change corresponds to the change from an order in which horizontal pixels are arranged to an order in which the pixels are processed, as shown in FIG. 25B.

Figure 26A:
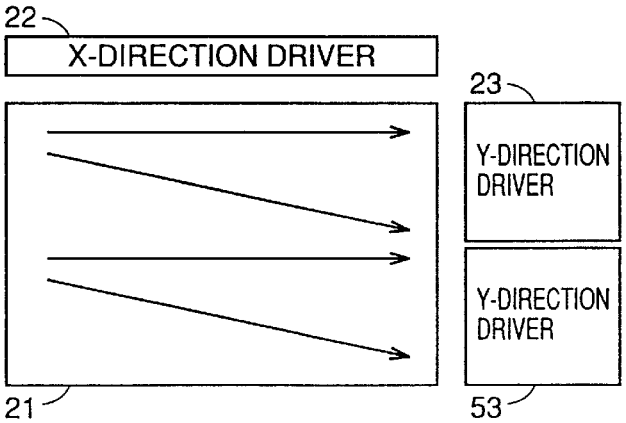
FIGS. 26A and 26B illustrate a method of driving a flat display, with its screen divided in two, upper and lower sides, via the flat display drive device of the present invention.
Figure 26B:
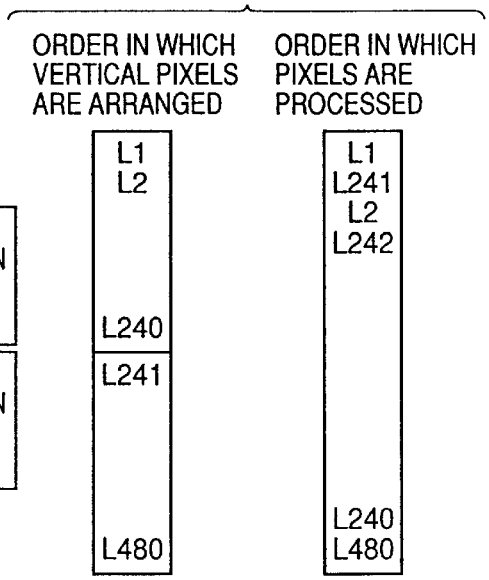
Figures 27, 28:
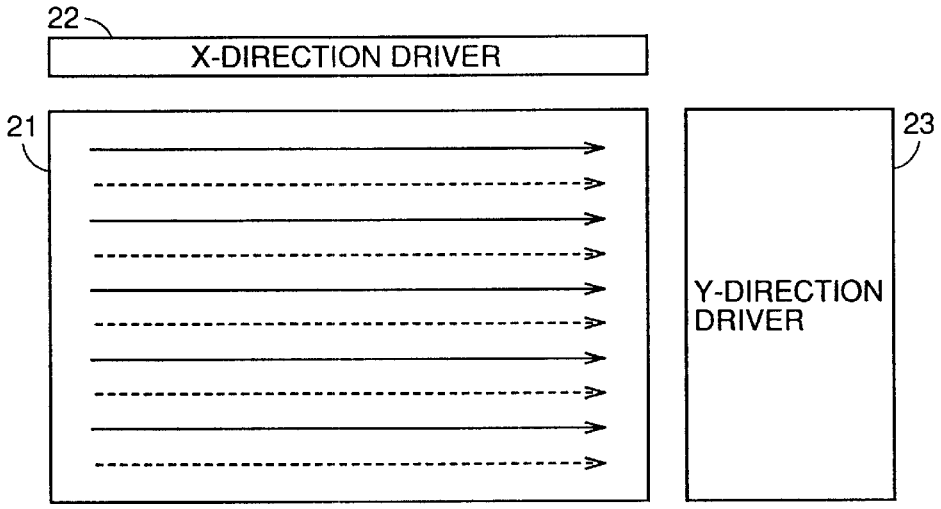
FIG. 27 represents a method of driving a flat display in an interlaced manner via the flat display drive device of the present invention.
FIG. 28 is a conceptual view representing a train of signals transmitted from a flat display drive device of the fifth embodiment of the present invention.

Such a display driving system, pixel arrangement associated therewith and the like as applied in driving a display with a screen bisected horizontally, as described with reference to FIGS. 25A and 25B, may also be similarly applied in driving a display with a screen bisected vertically, as shown in FIGS. 26A and 26B, driving a display in an interlaced manner, as shown in FIG. 27, and the like. In any case, transmitting a signal to be displayed that matches a display driving system allows the signal processing on the display side to be simplified.

Also, driving-system signal generation unit 148 can produce arrangement information to be transmitted, additional information such as information to the user, and other information which can be transmitted to parallel-serial conversion unit 131 and therein superimposed on data to be transmitted and thus transmitted to display drive circuit 430. For example, with a signal to be transmitted configured of a delimiter signal, control information and information to be displayed, as shown in FIG. 28, the control information output from driving-system signal generation unit 148 is superimposed in parallel-serial conversion unit 131. The delimiter signal corresponds, e.g., to a synchronizing signal, separating and discriminating the information to be displayed and the control information. The control information is comprised of additional information, such as the arrangement information being transmitted, the information to the user. The information to be displayed is x- and y-direction signals and the like.

The superimposed signals are then modulated and upconverted and then transmitted, and has been described above. In display drive circuit 330, driving-system signal discrimination unit 149 discriminates the control information from the received information. According to the diving-system and the arrangement information being transmitted, x- and y-direction drivers 22 and 23 and other components are driven by a predetermined driving system.

If display drive circuit 430 does not have detection unit disposed to detect information on display configuration 150, transmission unit 151 or reception unit 147, then transmitted control information may be determined by driving-system signal discrimination unit 149 to drive flat display 21 according to an arrangement of a signal to be transmitted of the transmitting side. If display drive circuit 430 has detection unit 150, transmission unit 151 and reception unit 147, then display chive signal transmission circuit 429 may provide transmission with an arrangement of a signal to be displayed that satisfies constraints on the flat display 21 side.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of driving a flat display, comprising steps of:

upconverting a signal to be displayed output from a display signal source into a millimeter-wave and transmitting said millimeter-wave;

receiving and downconverting said millimeter-wave to output said signal to be displayed; and supplying said signal to be displayed to a flat display, wherein:

said upconverting is provided through ASK (amplitude shift keying) modulation; and said downconverting is provide through ASK demodulation.

2. A method of driving a flat display, comprising steps of:

upconverting a signal to be displayed output from a display signal source into a millimeter-wave and transmitting said millimeter-wave;

receiving and downconverting said millimeter-wave to output said signal to be displayed; and supplying said signal to be displayed to a flat display, wherein:

said upconverting is provided through PSK (phase shift keying) modulation; and said downconverting is provided through PSK demodulation.

3. A method of driving a flat display, comprising steps of:

upconverting a signal to be displayed output from a display signal source into a millimeter-wave and transmitting said millimeter-wave;

receiving and downconverting said millimeter-wave to output said signal to be displayed; and supplying said signal to be displayed to a flat display, wherein:

said upconverting is provided through FSK (frequency shift keying) modulation; and said downconverting is provided through FSK demodulation.

4. A flat display driving device comprising:

a display signal source producing a signal to be displayed;

a first frequency conversion circuit receiving said signal to be displayed and converting said signal to be displayed into a millimeter-wave;

a millimeter-wave transmission circuit producing a radio-frequency wave for transmitting said millimeter-wave;

a millimeter-wave reception circuit receiving said radio-frequency wave to produce said millimeter-wave;

a second frequency conversion circuit receiving said millimeter-wave from said millimeter-wave reception circuit and converting said millimeter-wave into said signal to be displayed;

a signal separation circuit receiving said signal to be displayed from said second frequency conversion circuit and separating said signal to be displayed into image signals in x and y directions;

a flat display having a plurality of display elements arranged in rows and columns, said flat display including an x-direction drive line arranged for each row of said display elements and a y-direction drive line arranged for each column of said display elements;

an x-direction driver responding to said x-direction image signal by supplying to said x-direction drive line a voltage signal for driving said display element; and a y-direction driver responding to said y-direction image signal by supplying to said y-direction drive line a voltage signal for driving said display element.

5. The flat display driving device according to claim 4, wherein said display signal source includes at least one of a personal computer, a TV set, Internet, a TV phone and a TV conference system.

6. The flat display driving device according to claim 4, wherein said signal to be displayed includes signals to be displayed in x and y directions of said flat display.

7. The flat display driving device according to claim 4, further comprising a signal conversion circuit arranged between said display signal source and said first frequency conversion circuit to convert said signal to be displayed from an analog signal to a digital signal, said first frequency conversion circuit receiving a digitally converted, said signal to be displayed to produce said millimeter-wave.

8. The flat display driving device according to claim 4, wherein:

said first frequency conversion circuit uses ASK (amplitude shift keying) modulation in producing said millimeter-wave; and said second frequency conversion circuit uses ASK demodulation in producing said signal to be displayed from said millimeter-wave.

9. The flat display driving device according to claim 4, wherein:

said first frequency conversion circuit uses PSK (Phase shift keying) modulation in producing said millimeter-wave from said signal to be displayed; and said second frequency conversion circuit uses PSK demodulation in producing said signal to be displayed from said millimeter-wave.

10. The flat display driving device according to claim 4, wherein:

said first frequency conversion circuit uses FSK (frequency shirt keying) modulation in producing said millimeter-wave from said signal to be displayed; and said second frequency conversion circuit uses ASK demodulation in producing said signal to be displayed from said millimeter-wave.

11. A flat display drive device comprising:

a display signal source producing a signal to be displayed;

a signal separation circuit separating said signal to be displayed into x- and y-direction signals for driving a flat display;

a modulation circuit using said x- and y-direction signals to modulate an intermediate-frequency wave;

a frequency conversion circuit converting into a radio-frequency wave the intermediate-frequency wave modulated by said modulation circuit;

a millimeter-wave transmitter generating a radio-frequency wave for transmitting said millimeter-wave;

a millimeter-wave receiver receiving said radio-frequency wave to produce said millimeter-wave;

a demodulation circuit demodulating said millimeter-wave to said x- and y-direction signals;

a flat display having a plurality of display elements arranged in rows and columns, said flat display including an x-direction drive line arranged for each row of said display elements, and a y-direction drive line arranged for each column of said display elements;

an x-direction driver for supplying said x-direction signal to said x-direction drive line;

a y-direction driver for supplying said y-direction signal to said y-direction drive line;

a first signal supply circuit for supplying said x-direction signal to said x-direction driver; and a second signal supply circuit for supplying said y-direction signal to said y-direction driver.

12. The flat display driver device according to claim 11, further comprising:

a positional-information superimposing circuit for superimposing on said x- and y-direction signals positional information on displaying on said flat display; and coordinate conversion circuit disposed to read said positional information from said x- and y-direction signals demodulated by said demodulation circuit and to convert a coordinate used to display said x- and y-direction signals based on said positional information.

13. The flat display drive device according to claim 11, further comprising:

an arrangement conversion circuit converting an arrangement of at least one of said x- and y-direction signals;

a circuit disposed to superimposing on said x- and y-direction signals conversion information on a method applied by said arrangement conversion circuit to convert the arrangement of at least one of said x- and y-direction signals; and coordinate conversion circuit disposed to read said conversion information from said x- and y-direction signals demodulated by said demodulation circuit and to change a method applied to drive said x- and y-direction drivers based on said conversion information.

14. The flat display drive device according to claim 11, further comprising:

a transmission circuit for transmitting configuration information on a configuration of said flat display;

a reception circuit for receiving said configuration information; and an arrangement conversion circuit using said configuration information received, to convert an arrangement of at least one of said x- and y-direction signals.

15. A flat display drive device comprising:

a display signal source producing a signal to be displayed;

a signal separation circuit separating said signal to be displayed into x- and y-direction signals for driving a flat display;

a modulation circuit modulating a millimeter-wave, depending on a signal obtained by time-division multiplexing said x- and y-direction signals;

a millimeter-wave transmitter having a digital modulator incorporated therein, transmitting via a radio-frequency wave a millimeter-wave corresponding to the millimeter-wave modulated by said modulation circuit;

a millimeter-wave receiver receiving said radio-frequency wave to produce said millimeter-wave;

a demodulation circuit demodulating said millimeter-wave to said x- and y-direction signals;

a flat display having a plurality of display elements arranged in rows and columns, said flat display including an x-direction drive line arranged for each row of said display elements, and a y-direction drive line arranged for each column of said display elements;

an x-direction driver for supplying said x-direction signal to said x-direction drive line;

a y-direction driver for supplying said y-direction signal to said y-direction drive line;

a first signal supply circuit for supplying said x-direction signal to said x-direction driver; and a second signal supply circuit for supplying said y-direction signal to said y-direction driver.

16. The flat display drive device according to claim 15, further comprising:

a positional-information superimposing circuit for superimposing on said x- and y-direction signals positional information on displaying on said flat display; and coordinate conversion circuit disposed to read said positional information from said x- and y-direction signals demodulated by said demodulation circuit and to convert a coordinate used to display said x- and y-direction signals based on said positional information.

17. The flat display drive device according to claim 15, wherein said modulation circuit modulates the millimeter-wave through one of ASK (amplitude shift keying)/PSK (phase shift keying)/FSK (frequency shift keying).

18. A method of driving a flat display, comprising the steps of:

upconverting a signal to be displayed output from a display signal source into a millimeter-wave;

producing a radio-frequency wave and transmitting said millimeter-wave;

receiving said radio-frequency wave and producing a millimeter-wave;

downconverting said millimeter-wave into said signal to be displayed; and separating said signal to be displayed into image signals in x and y directions of said flat display, and supplying those respective signals as voltage signals for driving said flat display.

19. The method according to claim 18, wherein said signal to be displayed output from said display signal source is converted from an analog signal to a digital signal before said signal to be displayed is upconverted.

* * * * *